United States Patent [19]

Abuyama et al.

[11] Patent Number: 4,857,954

[45] Date of Patent: Aug. 15, 1989

[54] IMAGE FORMING APPARATUS

[75] Inventors: Yasuo Abuyama, Ebina; Fumito Ide, Zama; Osamu Hamanaka, Yokohama; Takeshi Sanbayashi, Tokyo, all of Japan

[73] Assignee: Kabushiki Kaisha Toshiba, Kawasaki, Japan

[21] Appl. No.: 168,573

[22] Filed: Mar. 7, 1988

Related U.S. Application Data

[60] Continuation of Ser. No. 915,524, Oct. 6, 1986, abandoned, which is a division of Ser. No. 727,859, Apr. 26, 1985, abandoned.

[30] Foreign Application Priority Data

Apr. 27, 1984 [JP] Japan ..... 59-85650

[51] Int. Cl.[4] ..... G03G 15/01; G03G 15/09

[52] U.S. Cl. ..... 355/245; 118/645; 118/657; 355/251

[58] Field of Search ..... 355/3 R, 3 DD, 4, 14 D; 118/645, 657, 658

[56] References Cited

U.S. PATENT DOCUMENTS

| | | | |
|---|---|---|---|
| 3,841,751 | 10/1974 | Draugelis et al. | 355/4 X |
| 3,960,445 | 6/1976 | Drawe | 355/4 |
| 4,090,787 | 5/1978 | Hubbard et al. | 355/14 R |
| 4,351,604 | 9/1982 | Karasawa et al. | 355/4 |
| 4,385,829 | 5/1983 | Nakahata et al. | 355/3 DD |
| 4,465,356 | 8/1984 | Joseph et al. | 355/4 X |
| 4,511,239 | 4/1985 | Kanbe et al. | 355/3 DD |
| 4,579,443 | 4/1986 | Abuyama et al. | 355/4 |
| 4,591,261 | 5/1986 | Saruwatari et al. | 355/4 |

*Primary Examiner*—Fred L. Braun

*Attorney, Agent, or Firm*—Cushman, Darby & Cushman

[57] ABSTRACT

An image-forming apparatus is provided with a photosensitive drum rotatably located in a housing, and a developing device for developing the latent image formed on the surface of the photosensitive drum. A first developing unit of the developing device develops the latent image by a first red developing agent. A second developing unit develops the latent image by a second black developing agent. The first and second developing units, each of which includes a developing roller and a magnet roll, are alternatively driven by a switch provided on a control panel which is located on the housing. The respective magnet rolls of the first and second developing units are allowed to rock through about 25 degrees each. As the magnet rolls rock within this range, magnetic brushes of the developing agents can be formed on the surfaces of the developing rollers, respectively, or removed therefrom. When the magnet rolls of the first and second developing units are shifted to the prescribed positions by a magnet roll drive mechanism, the magnetic brushes are formed on the surface of only one of the developing rollers of the first and second developing units.

19 Claims, 25 Drawing Sheets a
1
1a
1b
2
3
4
5
6
7
8
9
10
11
12
13
14
15
16
17
18
19
20
21
22
23
24
25
26
27
28
29
30
31a
31b
32a
32b
40a
40b
42a
42b
52a
52b
53a
53b
117b
131
b
P1
P2

STAND-BY MODE

IMAGE FORMING APPARATUS

This is a continuation of application Ser. No. 915,524, filed Oct. 6, 1986, which was abandoned upon the filing hereof, which is a divisional of Ser. No. 727,859 filed Apr. 26, 1985 now abandoned.

BACKGROUND OF THE INVENTION

The present invention relates to an image forming apparatus capable of developing a copy image on a copy paper sheet, in a single cycle of its copying operation, using a developing agent of any desired color, and more specifically relates to an image-forming apparatus, such as a color copying machine, in which developing agents of different colors are used individually, in a plurality of cycles of its copying operation, repeated for a single sheet of copy paper, thereby permitting multicolor copying.

Development of color versions has recently been promoted in the field of copying machines. For example, two-color copying machines have been developed for practical use, which can produce color images enjoying another color as well as black. In the conventional color copying machines of this type, however, developing agents of different colors are used individually in a plurality of cartridges which each include a developing unit and a photosensitive member in integral relation. A plurality of color copying operations are performed by alternatively replacing the cartridges with one another. Thus, the prior art color copying machines require a troublesome series of operations.

SUMMARY OF THE INVENTION

The present invention has been developed in consideration of these circumstances, and is intended to provide an image-forming apparatus which in a selected image-forming mode, can form an image with a plurality of colors (including a standard color), without replacing cartridges including development units.

According to one aspect of the present invention, there is provided an image-forming apparatus which comprises a housing; an image carrier located in the housing and adapted to carry thereon a latent image corresponding to an original image; developing means for developing the latent image formed on the surface of the image carrier, the developing means including first developing means for developing the latent image by means of a first developing agent, and second developing means for developing the latent image by means of a second developing agent; and means for alternatively driving the first and second development means.

BRIEF DESCRIPTION OF THE DRAWINGS

FIGS. 4, 5 and 6 show the arrangements of driving force transmission systems, in which FIG. 4 is a front view showing engagement between a group of gears; FIG. 5 is a sectional view showing the group of gears; and FIG. 6 is a sectional view showing the way a driving force is transmitted to a driving gear;

DETAILED DESCRIPTION OF THE PREFERRED EMBODIMENT

One embodiment of an image-forming apparatus according to the present invention, applied to an electronic copying machine, will now be described in detail with reference to the accompanying drawings.

Figure 1:
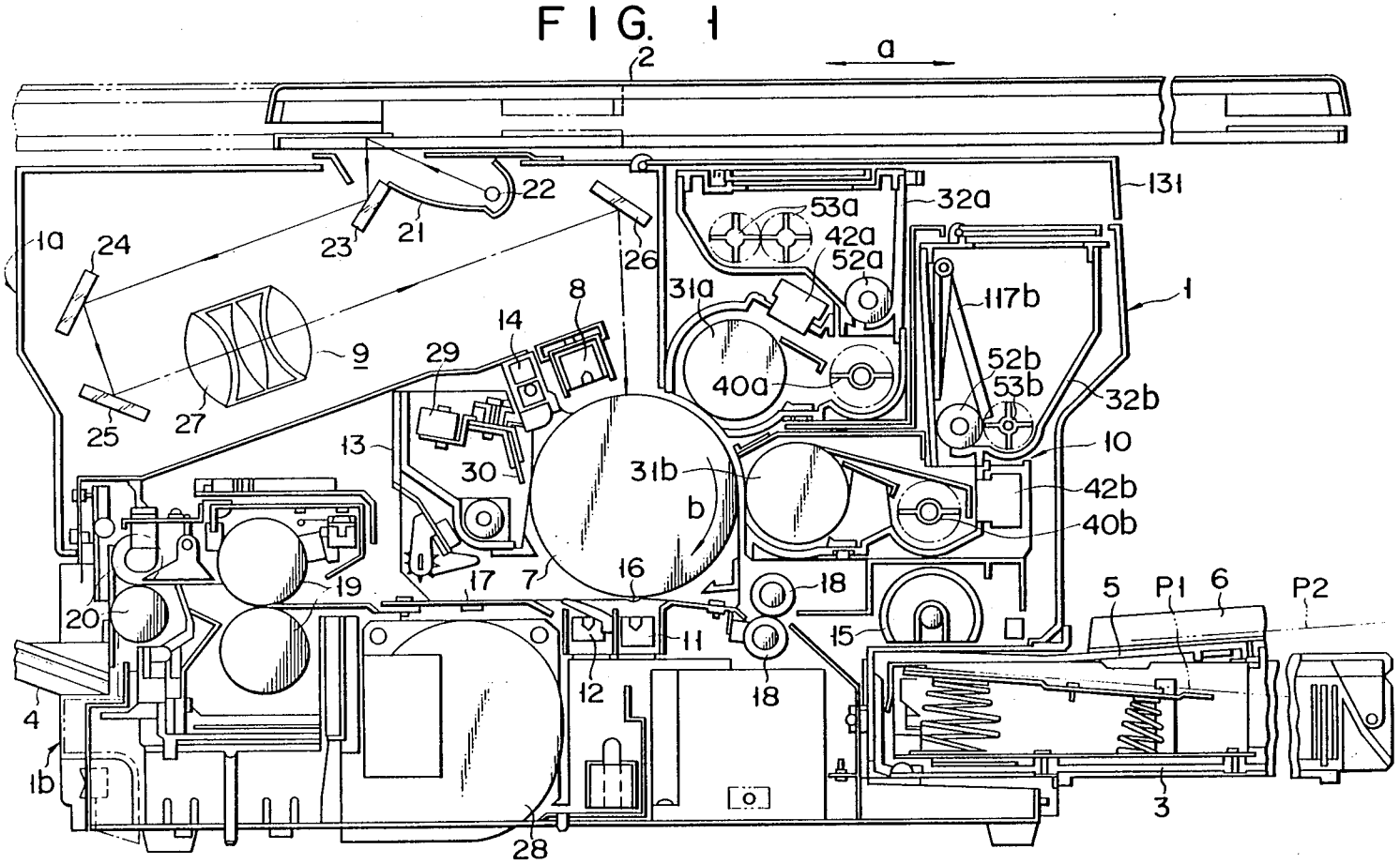
FIG. 1 is a side view schematically showing a color copying machine, as one embodiment of an image-forming apparatus according to the present invention.

FIG. 1 shows a two-color copying machine, as an example of the image-forming apparatus of the present invention. In FIG. 1, numeral 1 designates a copying machine housing. The housing 1 carries thereon an original table 2 which can reciprocate in the longitudinal direction of the housing 1 as indicated by arrow a. A paper cassette 3, storing a stack of copy paper P1 and a receiving tray 4 are removably attached to the right- and left-hand side portions of the housing 1, respectively. A cassette cover 5 is provided on the top of the paper cassette 3. The top surface of the cassette cover 5 serves as a sheet-bypass guide 6 for copy paper sheets P2, to be manually supplied as required. A photoconductive drum 7 is located in the substantially central portion of the housing 1, so as to be rotatable in a clockwise direction, as indicated by arrow b. The photoconductive drum 7 is surrounded by a main charger 8, an optical system 9, a two-color developing device 10 (described in detail later), a transfer charger 11, a separation charger 12, a cleaning unit 13, and a discharge lamp 14, which are arranged successively in the rotating direction of the drum 7. At the lower portion of the housing 1 extends a paper conveying path 17, along which a paper sheet P1 automatically delivered from the paper cassette 3 by a paper-supply roller 15) or a paper sheet P2 (manually supplied through the sheet-bypass guide 6) is fed and discharged into the receiving tray 4, through an image transfer section 16 defined between the photoconductive drum 7 and the transfer charger 11. A pair of aligning rollers 18 are arranged in the paper conveying path 17, on the upper-course side of the image transfer section 16 with respect to the direction of paper feed, and a pair of heat rollers 19, constituting a fixing unit, and a pair of exit rollers 20, are arranged on the lower-course side.

The optical system 9 includes an exposure lamp 22 backed by a reflector 21, mirrors 23, 24, 25, and 26, and a lens 27.

The photoconductive drum 7 is driven, in the direction indicated by arrow b, by a drive mechanism (not shown), in synchronism with the reciprocation of the original table 2. In operation, the surface of the photoconductive drum 7 is first charged uniformly by the main charger 8. Then, an original is uniformly irradiated by the exposure lamp 22, and the reflected light from the original is projected on the photoconductive drum 7 by the optical system 9, forming an electrostatic latent image, thereupon. The electrostatic latent image formed in this manner is developed into a visible image by the developing device 10, and placed opposite the transfer charger 11.

The automatically or manually supplied sheet P1 or P2 is fed into the image transfer section 16 by the aligning rollers 18, timed to the formation of the visible image. In the image transfer section 16, the toner image previously formed on the photoconductive drum 7 is transferred to the surface of the sheet P1 or P2, by the transfer charger 11. Then, the sheet P1 (P2) with the transferred toner image thereon is separated from the photoconductive drum 7 by the separation charger 12, and delivered to the heat rollers 19, through the paper conveying path 17. After the transferred image is melted and fixed on the sheet P1 (P2) by the heat rollers 19, the sheet P1 (P2) is discharged into the receiving tray 4 by the exit rollers 20.

After the toner image is transferred to the surface of the sheet P1 (P2), the residual developing agent remaining on the photoconductive drum 7 is removed by the cleaning unit 13, and a any residual image on the photoconductive drum 7 is erased by the discharge lamp 14, so as to be ready for the next cycle of the copying operation.

Inside the housing 1, upper and lower frames (not shown) are pivotally mounted at one end portion, on a supporting shaft (not shown). With this arrangement, the other end portions of the two frames can be swung apart at a desired angle, i.e., up to about 30 degrees from each other.

The upper frame is fitted by suitable means, with the photoconductive drum 7 and the other devices surrounding the same, including the main charger 8, the optical system 9, the exposure lamp 22, and developing device 10, the cleaning unit 13, and the discharge lamp 14. The upper frame is further mounted with the original table 2 and the paper-supply roller 15, thus constituting an upper unit 1a. On the other hand, the lower frame is fitted by suitable means with the paper cassette 3, the transfer charger 11, the separation charger 12, the heat rollers 19, the exit rollers 20, the receiving tray 4, and a main motor 28, thus constituting a lower unit 1b. Therefore, the paper conveying path 17 can be substantially fully exposed by removing a front cover (not shown) and then swinging the upper unit 1a upward from the lower unit 1b, by releasing a housing lock device (not shown).

The cleaning unit 13 is provided with a blade solenoid 29 for causing a cleaning blade 30 to make contact with and withdraw from the photoconductive drum 7.

The construction of the developing device 10 will now be described in detail.

Figure 2:
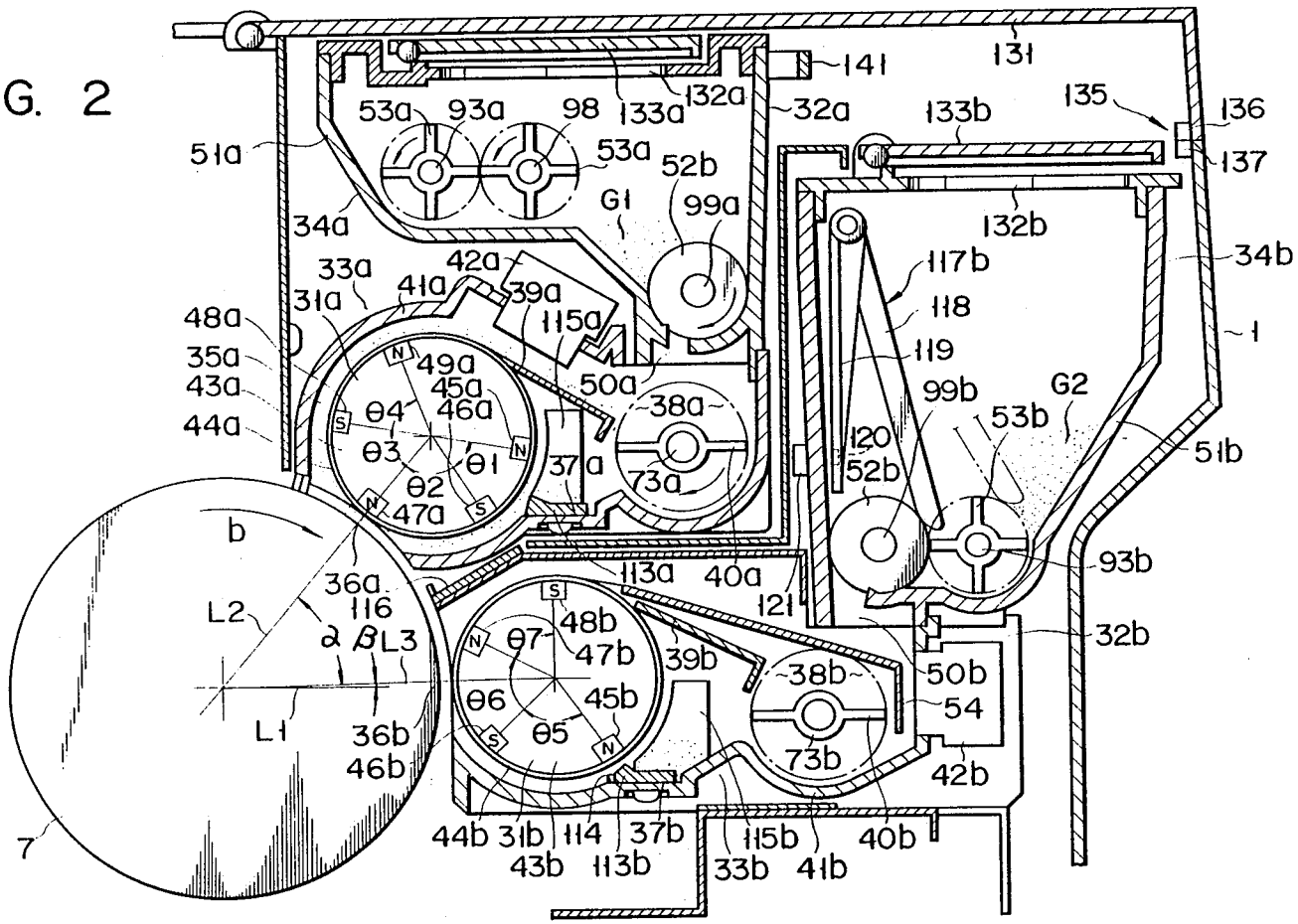
FIG. 2 is a vertical sectional view schematically showing a developing device.

As shown in detail in FIG. 2, the developing device 10 includes first and second developing rollers **31*a* and 31*b***, which are alternatively driven for regular developing using black as a standard color, or color developing using a color other than black, such as red, yellow, blue, or green.

The developing device 10 is vertically divided into two parts; a first developing unit **32*a* including the first developing roller 31*a*, and a second developing unit 32*b* including the second developing roller 31*b*. Both the first and second developing units 32*a* and 32*b* can be removably set in the housing 1. In this embodiment, the first or upper developing unit 32*a* is constructed so that a user can easily draw it out upward from the housing 1, while the second or lower developing unit 32*b* is designed for a serviceman's lateral attachment, for detachment for maintenance or inspection. A black developing agent G2, in greater demand, is used in the second developing unit 32*b*, and a color developing agent G1 in the first developing unit 32*a***.

The first developing unit **32*a* comprises a developing mechanism section 33*a* and a developing agent supply section 34*a*. The developing mechanism section 33*a* includes the first developing roller 31*a*; a doctor 37*a* located on the upper-course side of a developing position 36*a* or a sliding contact region between the photoconductive drum 7 and a magnetic brush 35*a* of the color developing agent G1 formed on the surface of the developing roller 31*a*, whereby the thickness of the magnetic brush 35*a* is regulated a scraper 39*a* located on the lower-course side of the developing position 36*a* and adapted to scrape off the magnetic brush 35*a* on the surface of the developing roller 31*a* and feed it into a developing agent storage portion 38*a*; a developing agent stirrer 40*a* in the developing agent storage portion 38*a*, and a casing 41*a* containing all these members. A developing agent density detector 42*a* is attached to that portion of the casing 41*a* which corresponds to the upper portion of the developing roller 31*a*. The density detector 42*a*** detects the density of the color developing agent G1, by magnetically sensing a change in the permeability of the developing agent G1.

The developing roller **31*a* is formed of a magnet roll 43*a*, whose center lies on a straight line L2 which passes through the center of rotation of the photoconductive drum 7, and is inclined at an angle $\alpha$ (about 51 degrees) to a horizontal line L1, and sleeve 44*a*, fitted on the outer peripheral surface of the magnet roll 43*a* and rotating in the clockwise direction of FIG. 2. The magnet roll 43*a* includes first to fifth polar blocks 45*a*, 46*a*, 47*a*, 48*a*, and 49*a*. The first, third and fifth polar blocks 45*a*, 47*a*, and 49*a* are north poles, while the second and fourth polar blocks 46*a* and 48*a* are south poles. The angle $\theta_1$ between the first and second polar blocks 45*a* and 46*a* is about 50 degrees, angle $\theta_2$ between 46*a* and 47*a* is about 71 degrees, angle $\theta_3$ between 47*a* and 48*a* is about 60 degrees, and angle $\theta_4$ between 48*a* and 49*b*** is about 60 degrees.

The developing agent supply section **34*a* includes a hopper 51*a* with a developing agent supply port 50*a*, facing the developing agent storage portion 38*a* of the developing mechanism section 33*a*; a developing agent supply roller 52*a* located in the hopper 51*a*, so as to close the developing agent supply port 50*a*; and a pair of stirring rollers 53*a* for stirring the developing agent G1 in the hopper 51*a*, so that the developing agent G1 is fed to the developing agent supply roller 52*a***.

The second developing unit **32*b* has substantially the same basic construction as the first developing unit 32*a* described above. The former differs from the latter in the shape of a hopper 51*b*** of a developing agent supply section 34*b*, the arrangement of poles of a magnet roll 43*b* of the developing roller 31*b*, the attachment position of a developing agent density detector 42*b*, and the addition of a narrow scraper 54 (e.g., 50 mm thick) with a tilt of about 20 degrees, to cope with the shift of the detector 42*b*. In the description to follow, like reference numbers, but with a suffix "b" each in place of "a", are used to designate like members as included in the first developing unit 32*a* and a detailed description of these numbers is therefore omitted.

The magnet roll 43*b* of the developing roller 31*b* includes first to fourth polar blocks 45*b*, 46*b*, 47*b* and 48*b*. The first and third polar blocks 45*b* and 47*b* are north poles, while the second and fourth polar blocks 46*b* and 48*b* are south poles. The angle $\theta_5$ between the first and second polar blocks 45*b* and 46*b* is about 70 degrees, angle $\theta_6$ between 46*b* and 47*b* is about 70 degrees, and angle $\theta_7$ between 47*b* and 48*b* is about 80 degrees. The center of the magnet roll 43*b* lies on a straight line L3 which passes through the center of rotation of the photoconductive drum 7, and is inclined at an angle $\beta$ (about 1 degree) to the horizontal line L1.

The respective magnet rolls 43*a* and 43*b* of the first and second developing units 32*a* and 32*b* are allowed to rock through about 25 degrees each. As the magnet rolls 43*a* and 43*b* rock within this range, magnetic brushes 35*a* and 35*b* of the developing agents can be formed on the surfaces of the developing rollers 31*a* and 31*b*, respectively, or removed therefrom. When the magnet rolls 43*a* and 43*b* (of the first and second developing units 32*a* and 32*b*) are shifted to their prescribed positions by a magnet roll drive mechanism (mentioned later), the magnetic brush 35*a* and 35*b* is formed on the surface of only one of the developing rollers 31*a* and 31*b* (of the first and second developing units 32*a* and 32*b*).

In operating the first developing unit 32*a*, the magnet roll 43*a* (of the first developing unit 32*a*) is set in a position such that the third polar block 47*a* faces the developing position 36*a*, and that the doctor 37*a* is located substantially halfway between the first and second polar blocks 45*a* and 46*b*, while the magnet roll 43*b* (of the second developing unit 32*b*) is set so that the first polar block 45*b* faces a doctor 37*b*, as shown in FIG. 2. Thus, the magnetic brush 35*a* is formed only on the surface of the developing roller 31*a* of the first developing unit 32*a*.

Figure 3:
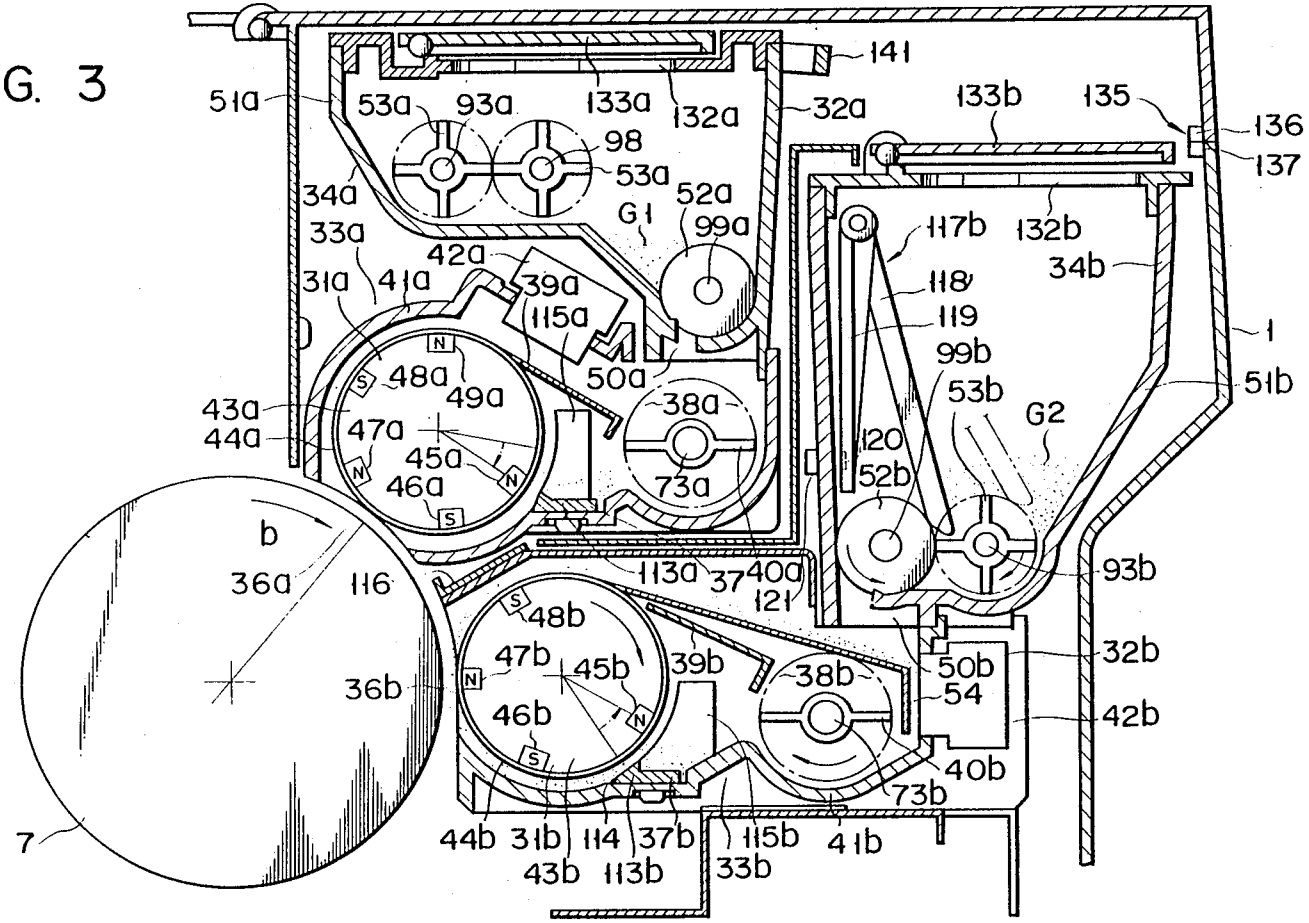
FIG. 3 is a vertical sectional view schematically showing the developing device of FIG. 2 in a different mode.

In operating the second developing unit 32*b*, on the other hand, the magnet roll 43*a* (of the first developing unit 32*a*) is rocked clockwise through about 25 degrees from the position of FIG. 2, so that the first polar block 45*a* faces the doctor 37*a*, and the magnet roll 43*b* (of the second developing unit 32*b*) is rocked counterclockwise through about 25 degrees from the position of FIG. 2, so that the doctor 37*b* is located substantially halfway between the first and second polar blocks 45*b* and 46*b*, as shown in FIG. 3. Thus, the magnetic brush 35*b* is formed only on the surface of the developing roller 31*b*, of the second developing unit 32*b*.

When the first polar block 45*a* (45*b*) of the magnet roll 43*a* (43*b*) is opposed to the doctor 37*a* (37*b*) (formed from a non-magnetic material), the magnetic brush 35*a* (35*b*) ceases to be formed on the surface of the developing roller 31*a* (31*b*) for the following reason. The magnetic brush on that portion of the surface of the sleeve 44*a* (44*b*), corresponding to the first polar block 45*a* (45*b*), is so sparse that it cannot positively attract the developing agent G1 (G2). Therefore, the formation of the magnetic brush 35*a* (35*b*) can easily be controlled by the doctor 37*a* (37*b*). Thus, by opposing the first polar block 45*a* (45*b*) to the doctor 37*a* (37*b*), the developing agent G1 (G2) is prevented from passing, by the doctor 37*a* (37*b*), even though the sleeve 44*a* (44*b*) rotates.

Driving forces for the moving parts of the first developing unit 32*a*, including the sleeve 44*a* of the developing roller 31*a*, the developing agent stirrer 40*a*, and the developing agent supply roller 52*a*, are transmitted by means of a first driving force transmission system 61, which will be described in detail later. Driving forces for the moving parts of the second developing unit 32*b*, including the sleeve 44*b* of the developing roller 31*b* and the developing agent stirrer 40*b*, are transmitted by means of a second driving force transmission system 62 mentioned later. The first and second driving force transmission systems 61 and 62, as shown in FIGS. 4 to 6, are adapted to alternatively actuate the drive system for one of the first and second developing units 32*a* and 32*b* when a reversible motor 63, as a common drive source, is rotated forwardly or reversely.

Figure 4:
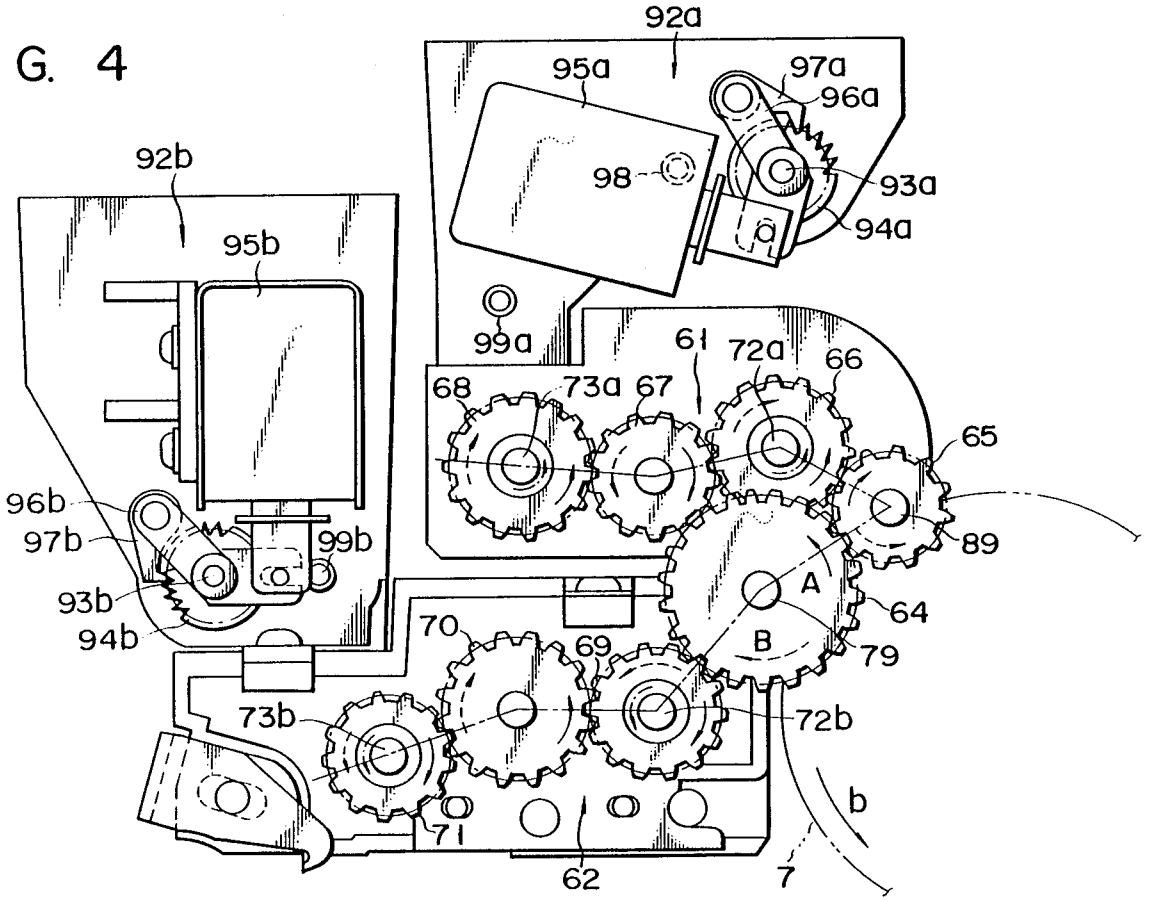
Figure 5:
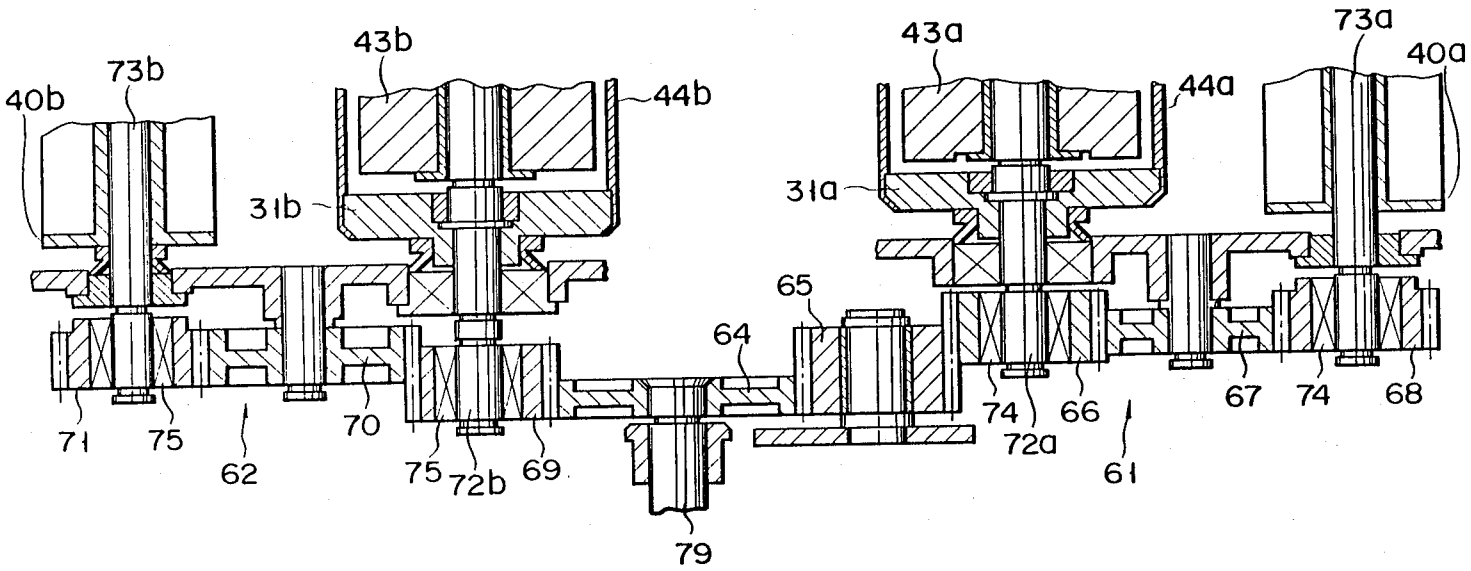
Figure 6:
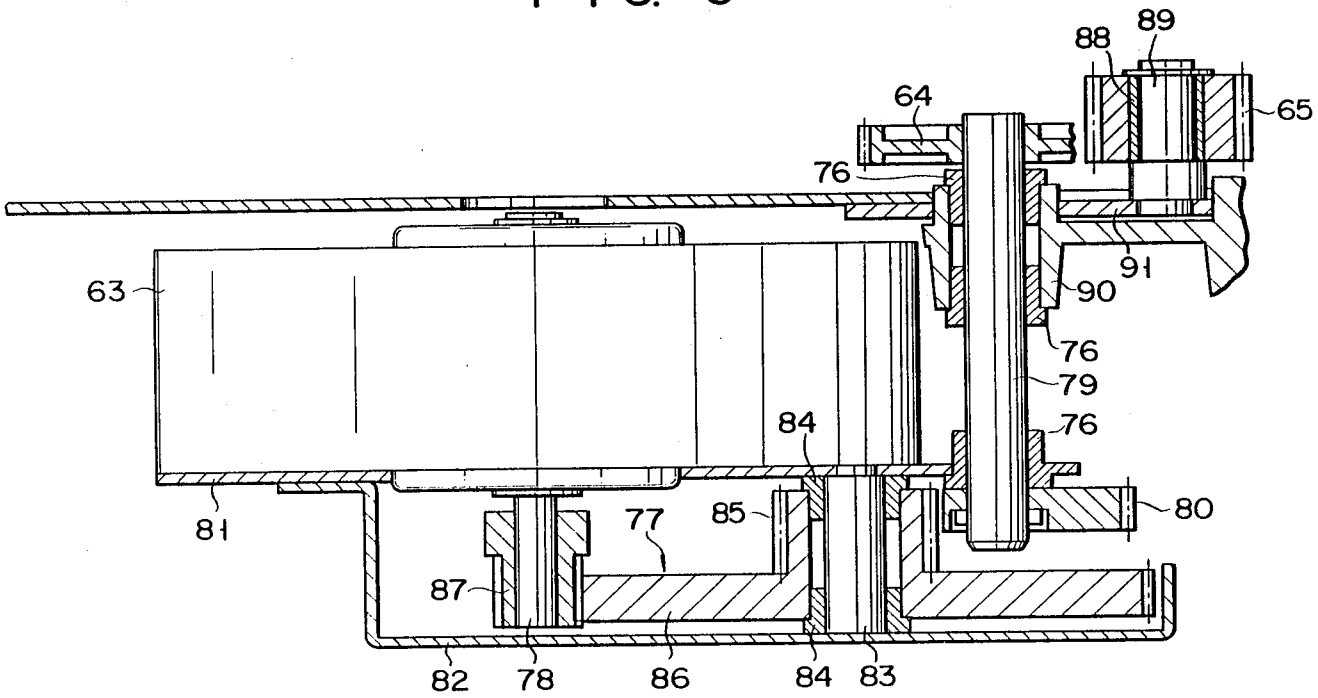
Figure 7:
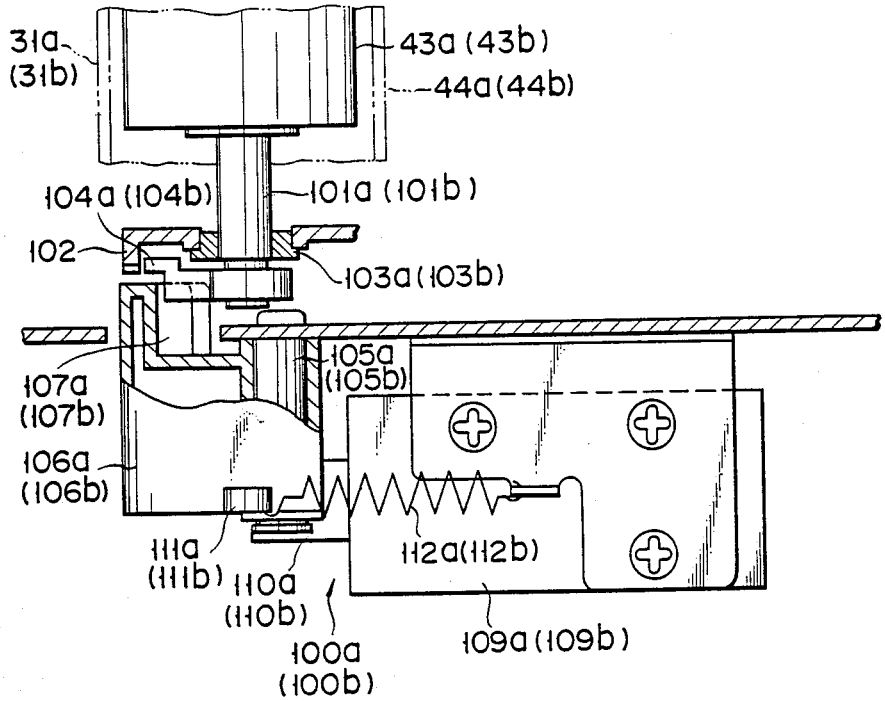
FIG. 7 is a plan view, partially in section, showing a magnet roll drive mechanism.

Referring now to FIGS. 4 to 6, the driving force transmission systems 61 and 62 will be described in detail. The first driving force transmission system 61 includes an intermediate gear 65 in mesh with a driving gear 64, which is driven by the reversible motor 63; a first driven gear 66 in mesh with the intermediate gear 65; an intermediate gear 67 in mesh with the driven gear 66; and a second driven gear 68 in mesh with the intermediate gear 67. The second driving force transmission system 62 includes a third driven gear 69 in mesh with the driving gear 64; an intermediate gear 70 in mesh with the driven gear 69; and a fourth driven gear 71 in mesh with the intermediate gear 70.

When the driving gear 64 is rotated forwardly or in the counterclockwise direction (indicated by full-line arrow A in FIG. 4) by the reversible motor 63, the individual gears 65, 66, 67, and 68 of the first driving force transmission system 61, and the gears 69, 70, and 71 of the second driving force transmission system 62, rotate in the directions indicated by the individual full-line arrows. On the other hand, when the driving gear 64 is rotated reversely or in a clockwise direction (indicated by broken-line arrow B) by the reversible motor 63, the gears 65 to 68 (of the first driving force transmission system 61) and the gears 69 to 71 (of the second driving force transmission system 62) rotate in the directions indicated by the individual broken-line arrows.

The first and second driven gears 66 and 68 are mounted on a driving shaft 72*a*, integral with the sleeve 44*a*, and a driving shaft 73*a* of the developing agent stirrer 40*a*, respectively, by means of their corresponding one-way clutches 74. The one-way clutches 74 transmit the driving force to the driving shafts 72*a* and 73*a* to rotate the same in the direction indicated by the chain-line arrows, only when the gears 66 and 68 rotate in the direction indicated by the full-line arrows, that is, when the driving gear 64 rotates forwardly.

The third and fourth driven gears 69 and 71 are mounted on a driving shaft 72*b*, integral with the sleeve 44*b* of the second developing roller 31*b*, and a driving shaft 73*b* of the developing agent stirrer 40*b*, respectively, by means of their corresponding one-way clutches 75. The one-way clutches 75 transmit the driving force to the driving shafts 72*b* and 73*b* to rotate the same in the direction indicated by the chain-line arrows, only when the gears 69 and 71 rotate in the direction indicated by the broken-line arrows, that is, when the driving gear 64 rotates reversely.

As shown in FIG. 6, the driving gear 64 is fixedly mounted on a rotating shaft 79 which is rotatably supported by bearings 76, and linked to a driving shaft 78 of the reversible motor 63, by means of a gear mechanism 77. More specifically, a gear 80 is mounted on the rotating shaft 79. The gear 80 is in mesh with a gear 85 which is rotatably mounted, by means of a pair of bearings 84, on a supporting shaft 83 stretched between a motor mounting frame 81 and a stay 82 integral therewith. The gear 85 is integrally formed with a larger gear 86. The gear 86 is in mesh with a gear 87, which is mounted on the driving shaft 78 of the reversible motor 63. Thus, both the forward and reverse rotations of the driving shaft 78 (of the reversible motor 63) are transmitted to the rotating shaft 79, and hence to the driving gear 64, through the gears 87, 86, 85 and 80, so that the first and second developing units **32*a* and 32*b* can be alternatively actuated by only changing the rotating direction of the reversible motor 63**.

The change of the rotational direction of the reversible motor 63 is accomplished by depressing a color selection key 156 on a control panel, which will be described in detail later. At the same time, the magnet roll **43*a* or 43*b* which is not engaged in operation is shifted by the magnet roll drive mechanism (described in detail later), so that its first polar block 45*a* or 45*b* faces its corresponding doctor 37*a* or 37*b***.

The intermediate gear 65, in mesh with the driving gear 64 and the first driven gear 66, is rotatably mounted on a supporting shaft 89, by means of a bearing 88. The supporting shaft 89 is attached to an arm 91, swingable around a housing 90 for holding the bearings 76, which support the rotating shaft 79. Thus, the intermediate gear 65 can shift its position, so that it may securely engage the driving gear 64 and the first driven gear 66.

One stirring roller **53*a* of the first developing unit 32*a* is intermittently driven by a first actuating mechanism 92*a* shown in FIG. 4. The other stirring roller 53*a* and the developing agent supply roller 52*a* are simultaneously driven in association with the rotation of the one stirring roller 53*a*. A ratchet wheel 94*a*, is mounted on one end of a shaft 93*a*, of the one stirring roller 53*a*, of the first developing unit 32*a*. The ratchet wheel 94*a* is intermittently rotated by regular angles, regulated by a pawl 97*a* attached to a swinging arm 96*a*, which rocks as a solenoid 95*a* is energized or deenergized. Sprocket wheels (not shown) are fitted individually on the respective shafts 93*a* and 98 of the pair of stirring rollers 53*a*, and on a shaft 99*a* of the developing agent supply roller 52*a*. A driving chain (not shown) is stretched between these sprockets, thereby constituting a driving force transmission system (not shown). The stirring rollers 53*a* and the developing agent supply roller 52*a*** are driven together by this driving force transmission system.

A stirring roller **53*b* and a developing agent supply roller 52*b*, of the second developing unit 32*b*, are simultaneously intermittently driven by a second actuating mechansim 92*b* with the same construction as the first actuating mechanism 92*a*, as well as by another driving force transmission system constructed in substantially the same manner as the aforesaid one. In FIG. 4, like reference numerals, but with a suffix "b" each in place of "a", are used to designate like members of the second actuating mechanism 92*b*, as included in the first actuating mechanism 92*a***.

Referring now to FIGS. 7, 8, 9A and 9B, the construction of a magnet roll drive mechanism **100*a* will be described, which rotates the magnet roll 43*a*, to form on or remove the magnetic brush 35*a* from the surface of the developing roller 31*a***.

One end of a shaft **101*a* of the magnet roll 43*a* is supported by a bearing 103*a*, which is attached to a frame 102. A lever 104*a* is attached to the extreme end of the shaft 101*a*. The distal end of the lever 104*a* is fitted in an engaging groove 107*a* of an arm 106*a*, which is rockably mounted on a supporting shaft 105*a*. A support portion 108*a* formed at the lower portion of the arm 106*a*, on its pivotal end side, is coupled to a plunger 110*a* of a solenoid 109*a*. One end of a tension spring 112*a* is coupled to a support portion 111*a*, which is formed at the upper portion of the arm 106*a*** on the pivotal end side.

Figure 8:
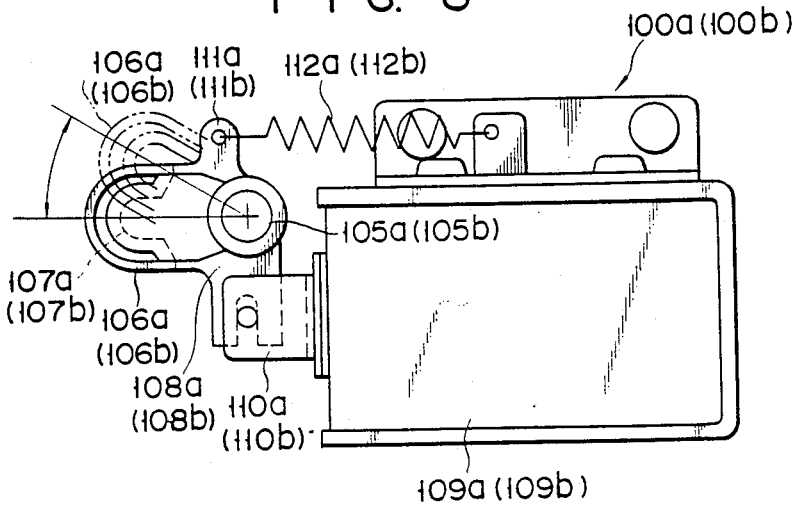
FIG. 8 is a side view of the magnet roll drive mechanism.
Figure 9A:
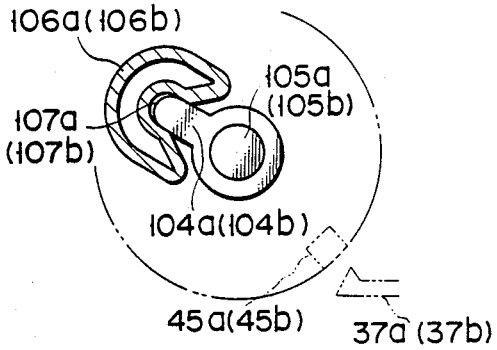
FIGS. 9A and 9B are side views showing the magnet roll drive mechanism in different positions.
Figure 9B:
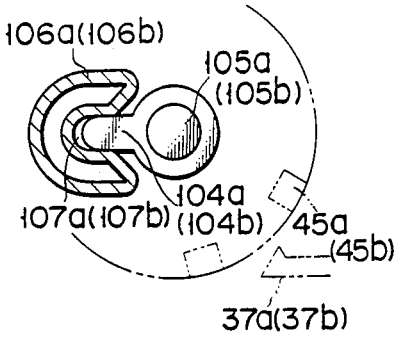

In the arrangement described above, when the solenoid **109*a* is off, the arm 106*a* is caused, by the urging force of the tension spring 112*a*, to hold the lever 104*a* in a position indicated by two-dot chain lines in FIG. 8, in which the doctor 37*a* faces the first polar block 45*a*, as shown in FIG. 9A. Thus, when the solenoid 109*a* is off, the magnetic brush 35*a* cannot be formed on the surface of the developing roller 31*a*. When the solenoid 109*a* is on, on the other hand, the arm 106*a* causes the lever 104*a* to rock against the urging force of the tension spring 112*a*, to a position indicated by full lines in FIG. 8, in which that portion of the magnet roll 43*a* halfway between the first and second polar blocks 45*a* and 46*a*, faces the doctor 37*a*, as shown in FIG. 9B. Thus, when the solenoid 109*a* is on, the magnetic brush 35*a* is formed on the surface of the developing roller 31*a***.

A magnet roll drive mechanism **100*b* for rotating the magnet roll 43*b*, to form on or remove the magnetic brush 35*b* from the surface of the developing roller 31*b*, is constructed in substantially the same manner as the magnet roll drive mechanism 100*a* described above. In FIGS. 7 to 9B, like reference numbers, but with a suffix "b" each in place of "a", are used to designate like members of the magnet roll drive mechanism 100*b* as included in the magnet roll drive mechanism 100*a***.

A solenoid **109*b* is designated so as to be off and on when the solenoid 109*a* is on and off, respectively. Thus, the magnetic brush 35*a* or 35*b* is alternatively formed on the surface of the first or second developing roller 31*a* or 31*b***.

As shown in FIGS. 2 and 3, the doctor **37*b* includes a doctor body 113*b* formed of nonmagnetic material, a magnetic member 114 formed of a beltlike iron plate extending along the longitudinal direction of the doctor body 113*b*, and a pair of magnetic members 115*b* (only one shown) at either end portion of the doctor body 113*b*. The magnetic members 114 and 115*b* and the first polar block 45*b* form lines of magnetic force between them, to positively prevent the developing agent G2 from being carried away from the hopper 51*b* when the first polar block 45*b* is opposed to the doctor 37*b*, so that the developing agent G2, on the surface of the developing roller 31*b***, is removed.

The doctor **37*a* includes a doctor body 113*a* formed of nonmagnetic material, and a pair of magnetic members 115*a* (only one shown) at either end portion of the doctor body 113*a*. The doctor 37*a* serves to prevent the developing agent G1 from being carried away, in the same manner as does the doctor 37b. Unlike the doctor 37b, the doctor 37a is not provided with any magnetic member extending along the longitudinal direction of the doctor body 113a. The developing agent G1 is prevented from being carried away, from the hopper 51a, by taking advantage of lines of magnetic force formed between the first polar block 45a of the developing roller 31a, opposite the doctor 37a and the fourth polar block 48b of the developing roller 31b**.

As shown in FIGS. 2 and 3, a magnetic plate 116 is interposed between the two developing rollers 31a and 31b. The magnetic plate 116 serves to reduce the influences of the magnetic flux density and polar distribution of the one magnet roll 43a (43b) on the other magnet roll 43b (43a), thereby ensuring satisfactory feed of the developing agents.

As shown in FIGS. 2 and 3, moreover, a developing agent shortage detecting unit 117b is located in the hopper 51b of the second developing unit 32b. The developing agent shortage detecting unit 117b detects reduction of the residual quantity of the developing agent G2, in the hopper 51b, to a predetermined level. The developing agent shortage detecting unit 117b includes a detecting lever 118, adapted to rock in accordance with the residual quantity of the developing agent G2 in the hopper 51b, an actuator 119 integral with the detecting lever 118, a permanent magnet 120 attached to the actuator 119, and a reed switch 121 as a sensor outside the hopper 51b. When the quantity of developing agent G2, in the hopper 51b, is reduced the permanent magnet 120 approaches the reed switch 121 to actuate the same. A developing agent shortage detecting unit 117a (not illustrated in FIGS. 2 and 3), similar to the detecting unit 117b, is located in the hopper 51a of the first developing unit 32a.

Figure 10:
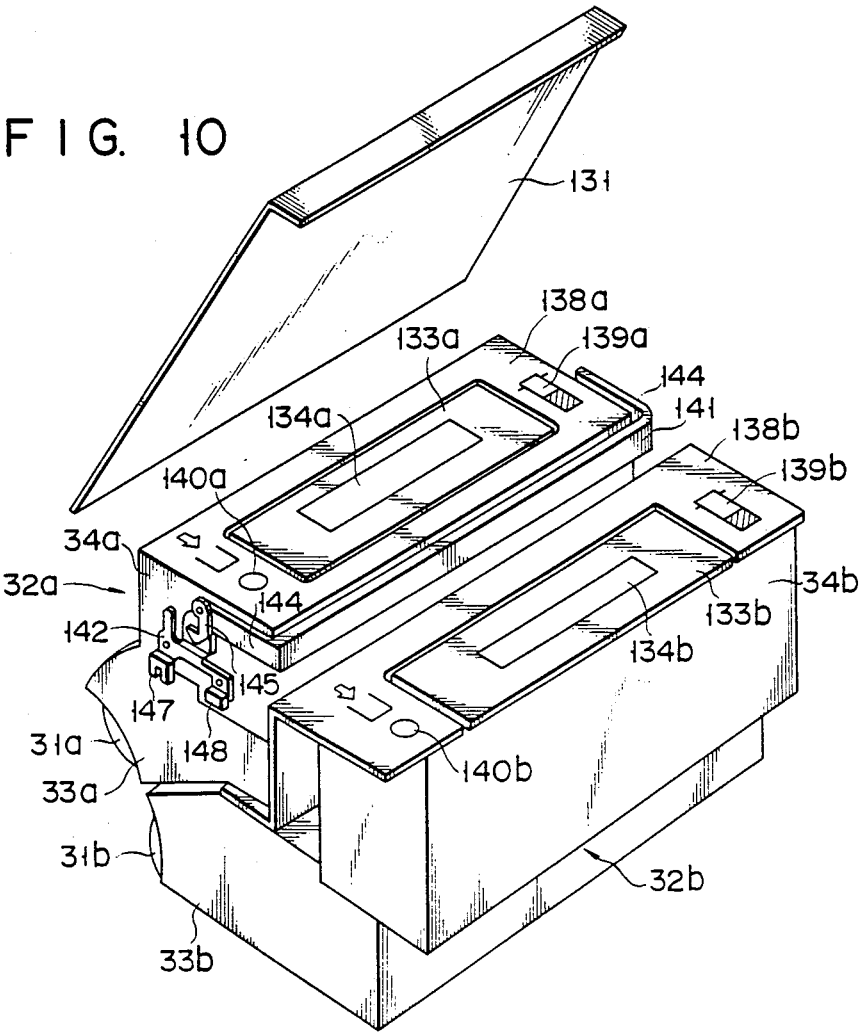
FIG. 10 is a perspective view schematically showing the developing device.

As shown in FIGS. 2, 3 and 10, a hopper cover 131, constituting part of the top face of the housing 1, is swingably located on the top side of the developing device 10. When the hopper cover 131 is removed, a lid 133a covering a top opening 132a for developing agent supply of the first developing unit 32a and a lid 133b covering a top opening 132b for developing agent supply of the second developing unit 32b are exposed at the same time. Thus, with the lids 133a and 133b taken off, the developing agents G1 and G2 can readily be supplied from the top side. The lids 133a and 133b are provided with color indicator 134a and 134b, respectively. The color indicators 134a and 134b facilitate discrimination by color between the developing agents G1 and G2 stored in the hoppers 51a and 51b, preventing the developing agents of different colors from being mixed.

In FIGS. 2 and 3, number 135 designates a cover position detection unit for detecting the state of the hopper cover 131. The cover position detecting unit 135 includes a permanent magnet 136 attached to the front end portion of the hopper cover 131, and a reed switch 137 as a sensor attached to the housing 1, and adapted to be turned on when the hopper cover 131 is shut down, to bring the magnet 136 into contact with the reed switch 137.

Figure 11A:
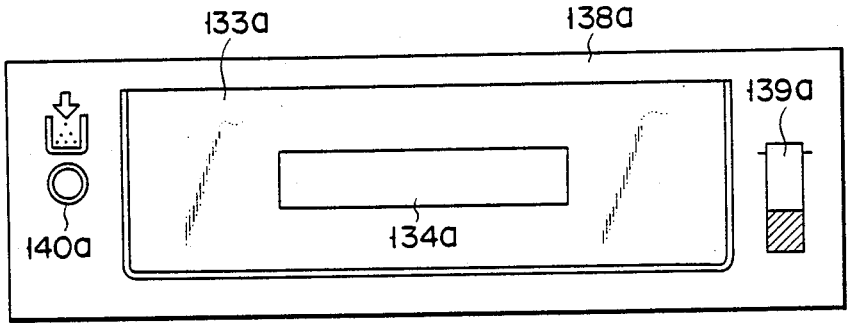
FIGS. 11A and 11B are top views individually showing a pair of developing units.
Figure 11B:
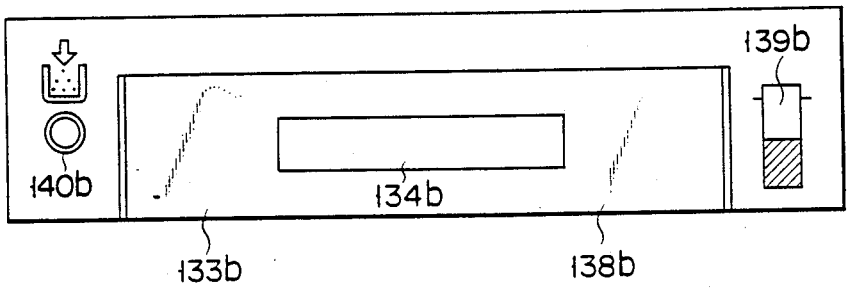
Figure 12:
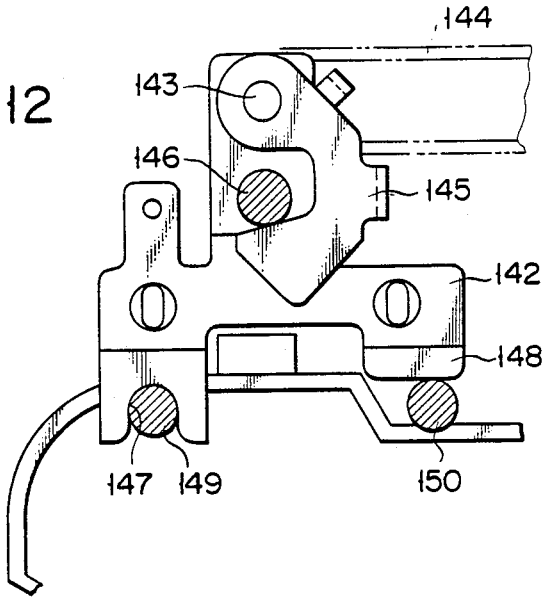
FIG. 12 is a front view showing means for affixing the developing device.

As shown in FIGS. 10, 11A and 11B, integrating timers 139a and 139b as life indicators, for indicating the remainder of the life of the developing agents, and developing agent absent indicators 140a and 140b, for indicating reduction in the quantity of developing agents in the hoppers 51a and 51b (of the first and second developing units 32a and 32b) to a predetermined level, are provided on top surface 138a and 138b of the hoppers 51a and 51b, on either side of the lids 133a and 133b. The integrating timers 139a and 139b indicate the remainder of the life of their corresponding developing agents by, for example, measuring the amount of rotation (time) of the sleeves 44a and 44b which constitute the developing rollers 31a and 31b, respectively. In this embodiment, for example, FC Timer (trademark of electrolytic integrating timer produced by Fuji Ceramics Co., Ltd.) is used for the integrating timers 139a and 139b.

The first developing unit 32a, storing the color developing agent G1, is in the form of a cartridge which can be removably set in the housing 1 from the top side thereof. The first developing unit 32a can easily be removed from the housing 1 by raising and drawing up a handle 141 (FIG. 10). A pair of positioning members 142 (only one of which is shown) are attached individually to the front and rear walls of the developing agent supply section 34a of the first developing unit 32a. Both end support portions 144 of the handle 141 are individually swingably mounted on the positioning members 142 by means of supporting shafts 143, individually. As shown in FIGS. 12, 13A, 13B and 13C, each support portion 144 of the handle 141 is fitted integrally with a hook 145 which can rock around its corresponding supporting shaft 143. The hook 145 engages its corresponding retaining pin 146 on the housing 1, thereby restraining the handle 141 from moving upward. An engaging recess 147 as a first positioning portion, and an end face 148 as a second positioning portion, both formed on the bottom side of each positioning member 142, are adapted to engage and abut against positioning pins 149 and 150 on the housing 1, respectively. Thus, the first developing unit 32a is held in a prescribed position.

Figure 13A:
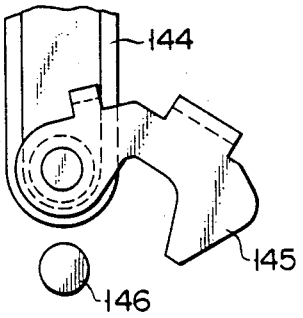
FIGS. 13A, 13B and 13C are front views showing a handle and a hook in different relative positions.
Figure 13B:
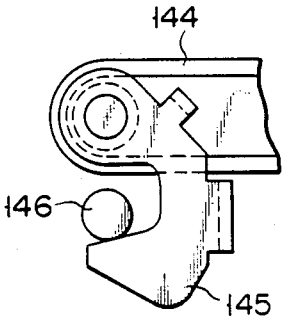
Figure 13C:
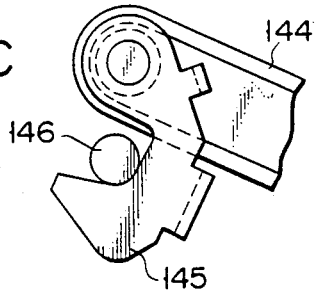

When the handle 141 is raised, the hook 145 is disengaged from the retaining pin 146, as shown in FIG. 13A. When the handle 141 is brought down to a substantially horizontal position, on the other hand, the hook 145 engages the retaining pin 146, as shown in FIG. 13B. When the handle 141 in the horizontal position is further pressed downward, the hook 145 and the retaining pin 146 engage each other more securely, as shown in FIG. 13C, so that the first developing unit 32a is held down. Thus, when the handle 141 is raised, the first developing unit 32a can be loaded or unloaded from the top side of the housing 1, and when the handle 141 is brought down after the first developing unit 32a is loaded, the first developing unit 32a can be affixed. In conclusion, the setting of the first developing unit 32a is very easy.

The developing operation of the developing device 10 will now be described. If the first developing unit 32a is selected for operation by means of the color selection key 156 shown in FIG. 14, the magnet rolls 43a and 43b will be situated as shown in FIG. 2. Meanwhile, the reversible motor 63 rotates forwardly, and only the sleeve 44a of the first developing roller 31a rotates clockwise from the position of FIG. 2. As a result, the magnetic brush 35a is formed on the surface of the sleeve 44a. Then, the electrostatic latent image previously formed on the photoconductive drum 7, is developed by the color developing agent G1. When the developing of the electrostatic latent image is accomplished in this manner, the magnet roll 43a rotates clockwise through about 25 degrees so that the polar block 45a faces the doctor 37a. Thus, the magnetic brush 35*a* ceases to be formed afresh on the surface of the sleeve 44*a*. In this state, the sleeve 44*a* further rotates through a predetermined angle, causing the magnetic brush 35*a* to be removed from the surface of the first developing roller 31*a*. At this time, the magnetic brush 35*b* is not formed on the surface of the second developing roller 31*b*, either. Thus, color mixing or any other trouble cannot be caused if the first or second developing unit 32*a* or 32*b* is selected for the next cycle of operation.

If the second developing unit 32*b* is selected for black developing operation, by means of the color selection key 156, the magnet rolls 43*a* and 43*b* are situated as shown in FIG. 3. Meanwhile, the reversible motor 63 rotates reversely, and only the sleeve 44*b*, of the second developing roller 31*b*, rotates clockwise from the position of FIG. 2. As a result, the magnetic brush 35*b* is formed on the surface of the sleeve 44*b*. Then, the electrostatic latent image on the photoconductive drum 7 is developed by the black developing agent G2. Thereafter, the magnetic brush 35*b* is removed from the surface of the sleeve 44*b* in the same manner as aforesaid, and the developing operation is thus completed.

The developing agent stirrer 40*a* (40*b*) and the stirring roller(s) 53*a* (53*b*) (of the developing unit 32*a* (32*b*)), when engaged in the developing operation, are normally rotating. Meanwhile, the developing agent supply roller 53*a* (53*b*) is rotated so that the developing agent G1 (G2) is supplied as required, in accordance with a control signal responsive to an output signal from the developing agent density detector 42*a* (42*b*). Thus, satisfactory developing operation can be maintained.

Figure 14:
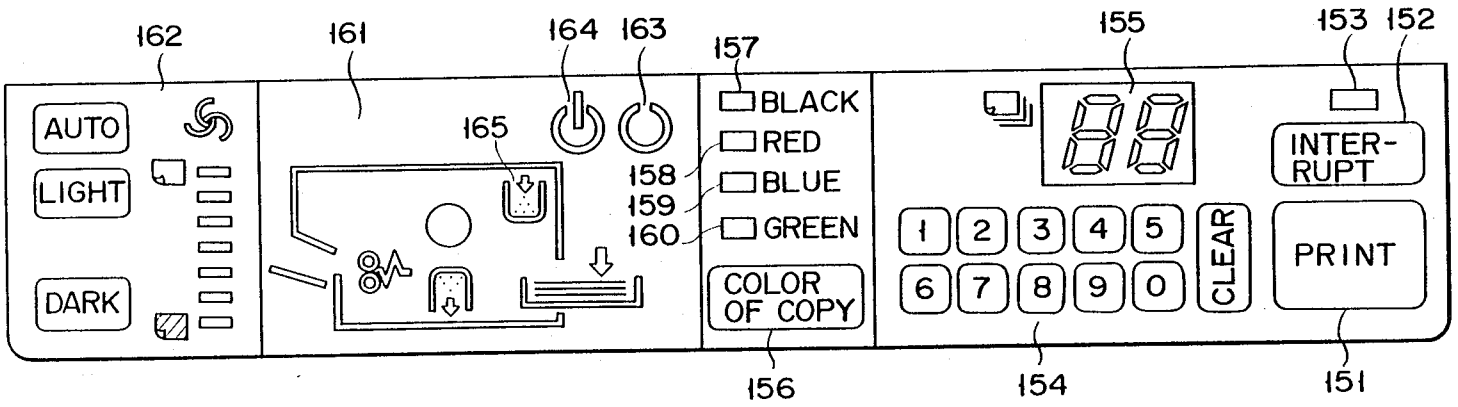
FIG. 14 is a plan view of a control panel.

FIG. 14 shows the control panel. The control panel bears thereon a copying key 151 for starting the copying operation; an interruption key 152 for designating an interruption mode for interruption copying; an interruption indicator 153 for indicating the interruption mode, a ten-key array 154 for setting the number of copies to be made; a copy number display 155 for indicating the number of copies made; the color selection key 156 for selecting the copy color (e.g., black, red, blue, green, etc); color indicators 157, 158, 159 and 160 for indicating the selected color; a liquid crystal display section 161 for indicating the operating mode or state; and a density setting section 162 for setting the copy density.

The liquid crystal display section 161 includes a ready-to-copy sign 163 for indication that the copying machine is ready for copying operation; a do-not-copy sign 164 for indication that the machine is not ready for the copying operation; and a developing agent absent sign 165 for an indication that a hopper or hoppers of the developing device 10 have been emptied of the developing agent(s).

Alternative color selection can be accomplished with each successive depression of the color selection key 156. Here let it be supposed that the first and second developing units 32*a* and 32*b* store therein the developing agent G1 of, e.g., a red color, and the black developing agent G2, respectively. In this case, when the power supply is turned on, the black copy mode is automatically established, the second developing unit 32*b* is actuated, and the black color indicator 157 is lighted. If the color selection key 156 is depressed in this state, a red copy mode is established, the first developing unit 32*a* is actuated, and the red color indicator 158 is lighted. If the color selection key 156 is depressed again in this state, the black copy mode is resumed. Thus, the black and red copy modes can alternately be selected by repeatedly depressing the color selection key 156.

Figure 15:
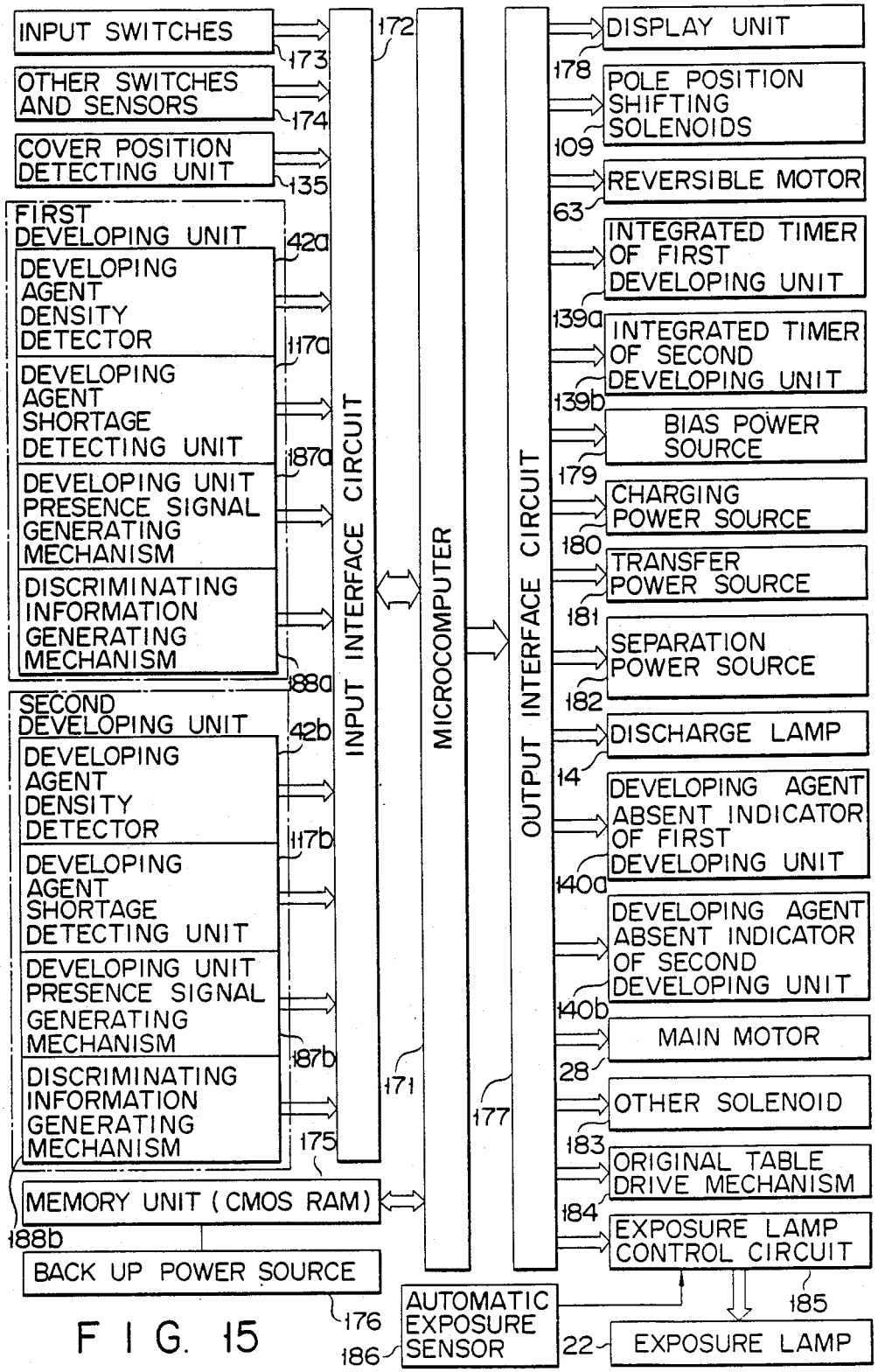
FIG. 15 is a block diagram schematically showing a general control circuit.

FIG. 15 shows a general control circuit of the copying machine. In FIG. 15, number 171 designates a microcomputer as a main control unit for the control of the copying machine as a whole. The input data of the microcomputer 171 is conveyed through an input interface circuit 172 with input switches 173, including the various keys on the control panel; various other switches and sensors 174 required for copying operation; the developing agent density detector 42*a* and the developing agent shortage detecting unit 117*a* of the first developing unit 32*a*; the developing agent density detector 42*b* and the developing agent shortage detecting unit 117*b* of the second developing unit 32*b*; and the cover position detecting unit 135. Also, the microcomputer 171 is connected directly with a memory unit 175. The memory unit 175 is backed up by a stand-by power source 176, such as batteries.

The data of the microcomputer 171 is conveyed through an output interface circuit 177, with a display unit 178 which includes the various indicators and display sections on the control panel; the pole position-shifting solenoids 109*a* and 109*b* of the first and second developing units 32*a* and 32*b*; the reversible motor 63; the integrating timers 139*a* and 139*b* of the first and second developing units 32*a* and 32*b*; a developing bias power source 179; a charging power source 180 for the main charger 8; a transfer power source 181 for the transfer charger 11; a separation power source 182 for the separation charger 12; the discharge lamp 14; the developing agent absence indicators 140*a* and 140*b*; the main motor 28; various other solenoids 183; an original table drive mechanism 184 for driving the original table 2; and an exposure lamp control circuit 185. The exposure lamp control circuit 185 controls the exposure lamp 22, in response to an output signal from an automatic exposure sensor 186 for detecting light from the exposure lamp 22, and a signal from the microcomputer 171.

Figure 16:
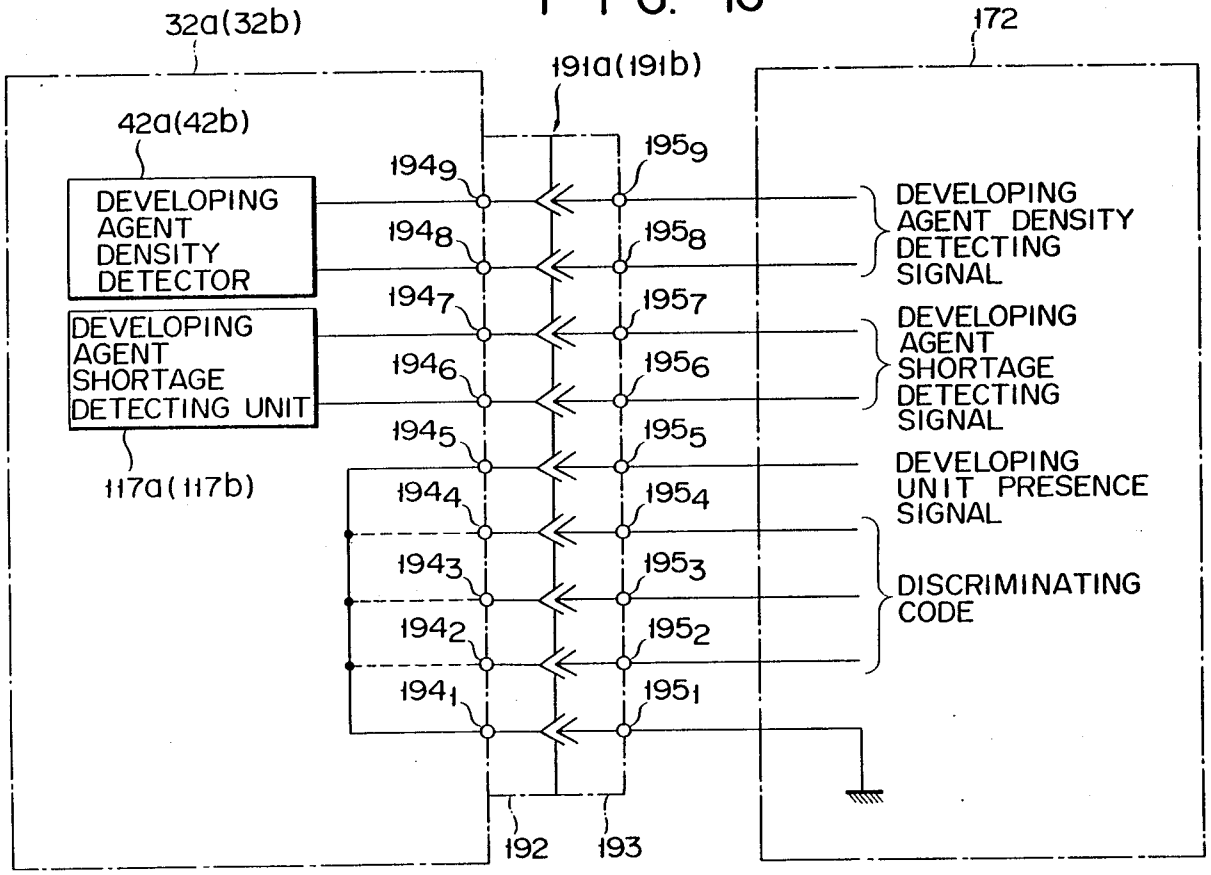
FIG. 16 is a diagram for illustrating developing unit presence signal generating mechanisms and discriminating information generating mechanisms.
Figure 17A:
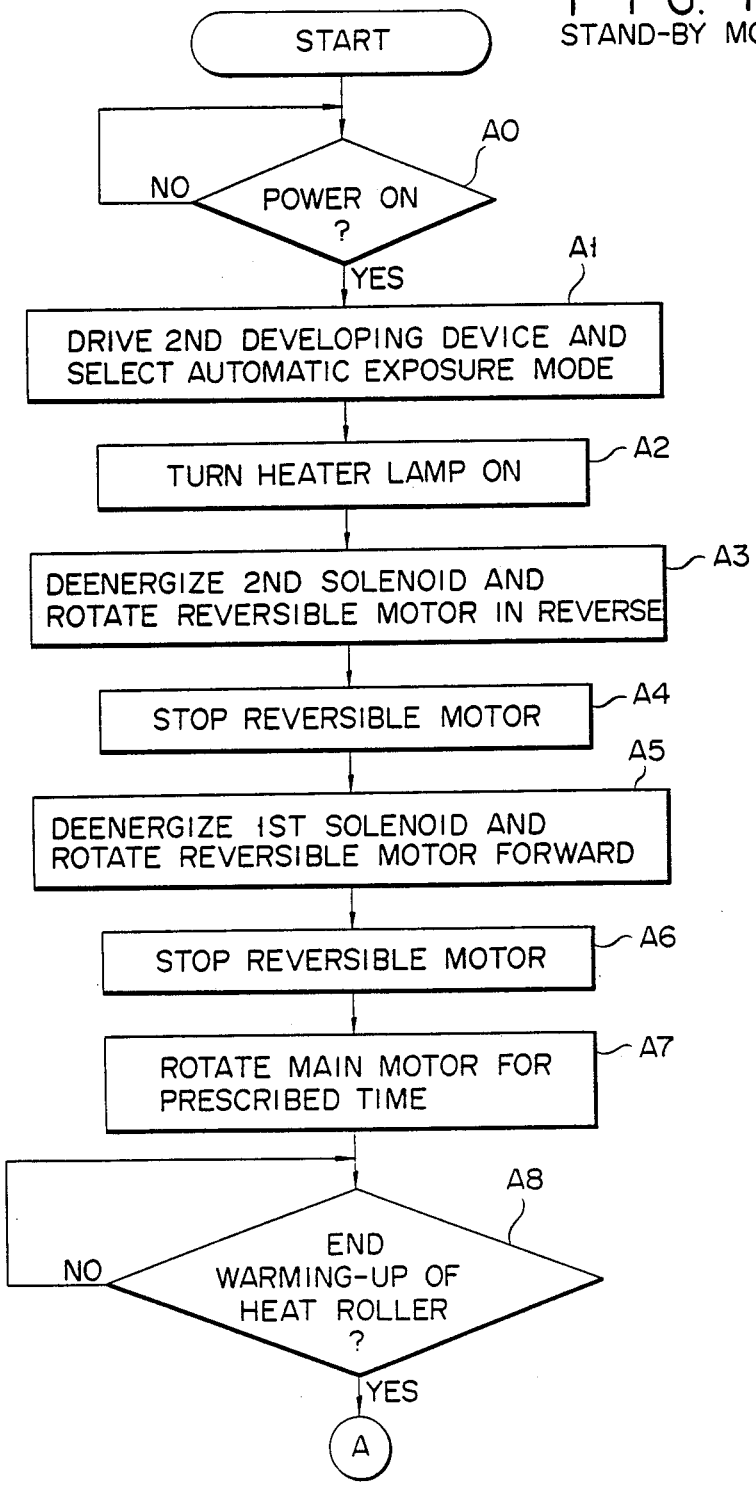
FIGS. 17A to 17F are flow charts for illustrating an operation mode at the start of power supply.
Figure 17B:
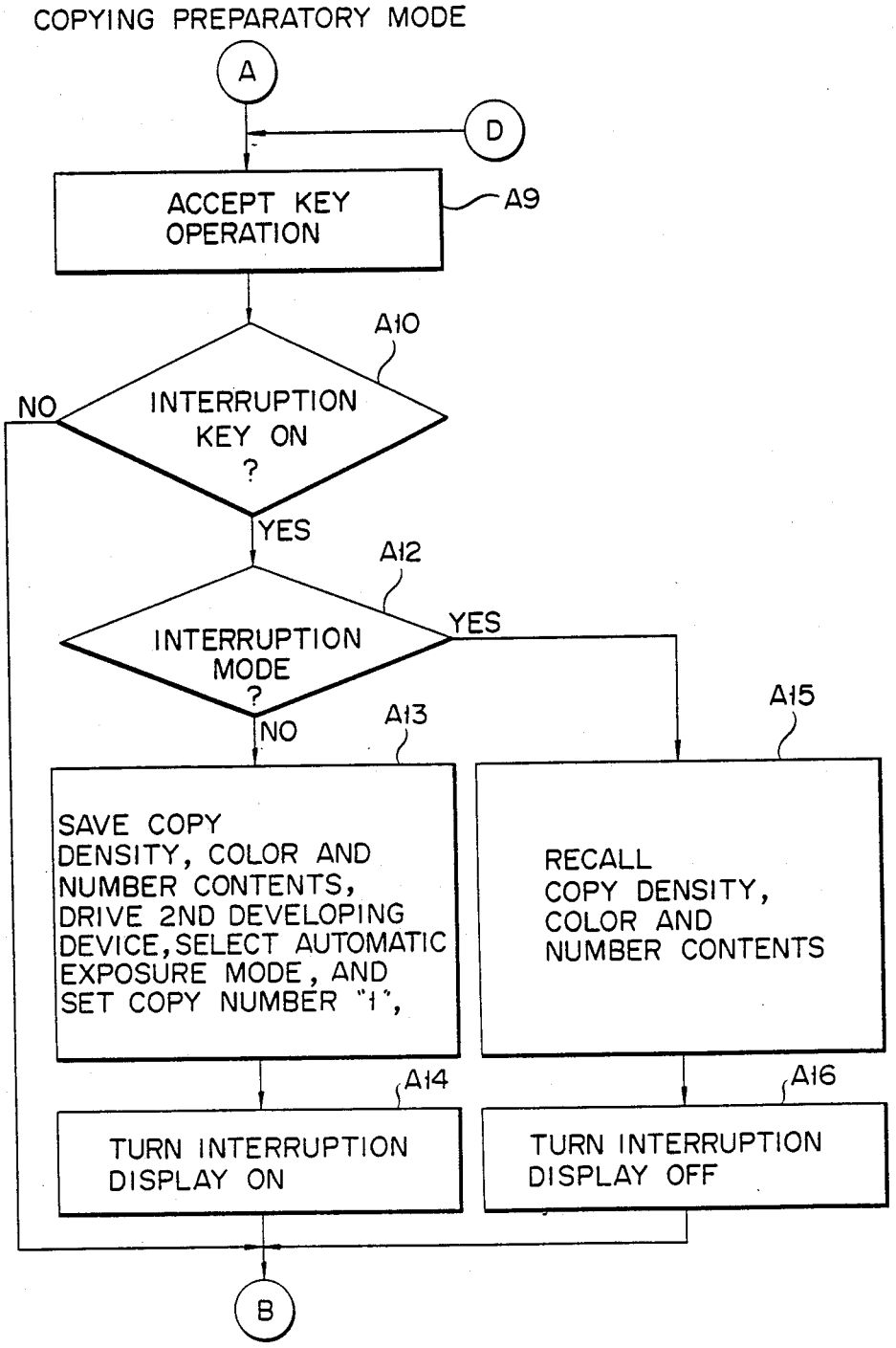
Figure 17C:
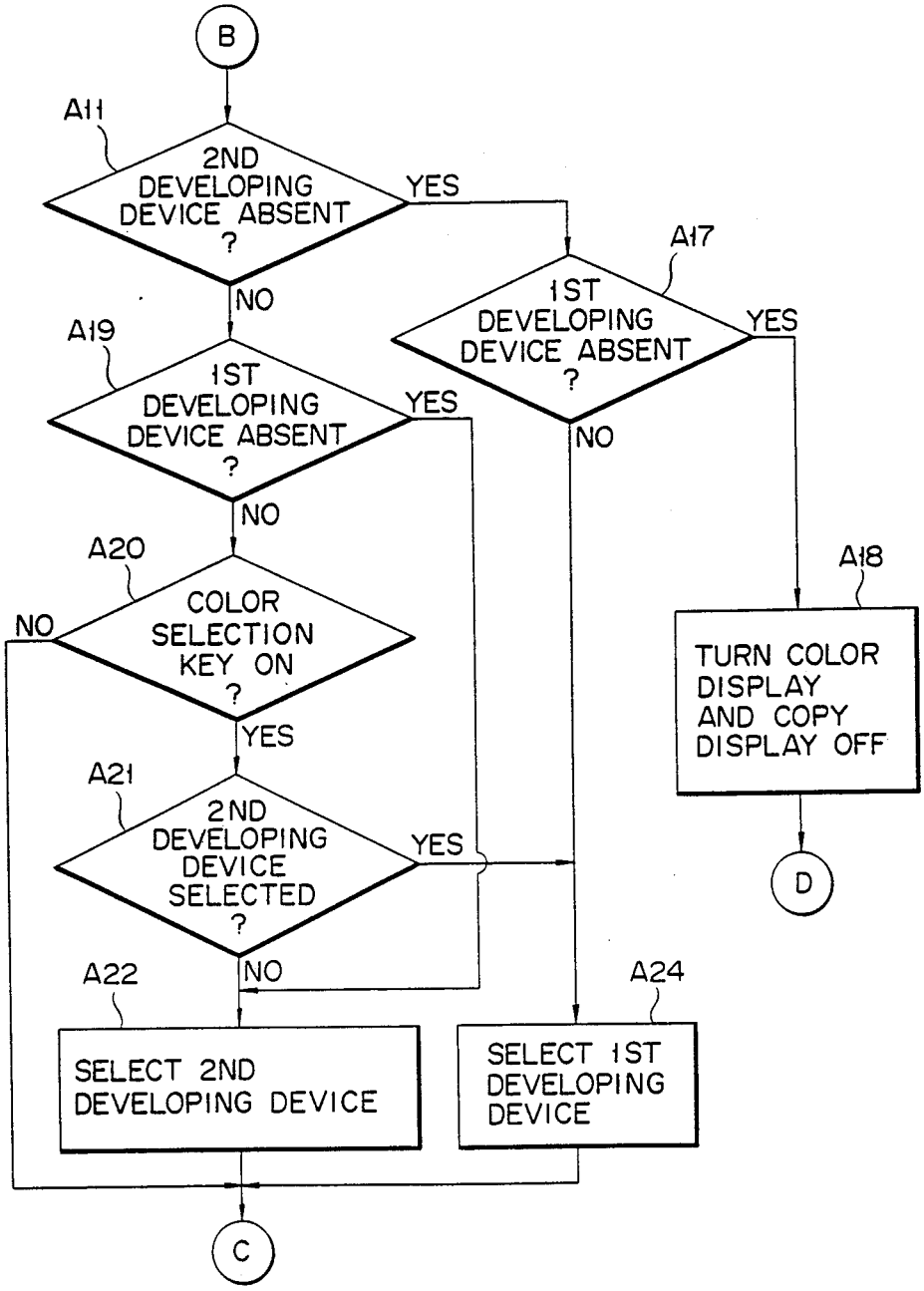
Figure 17D:
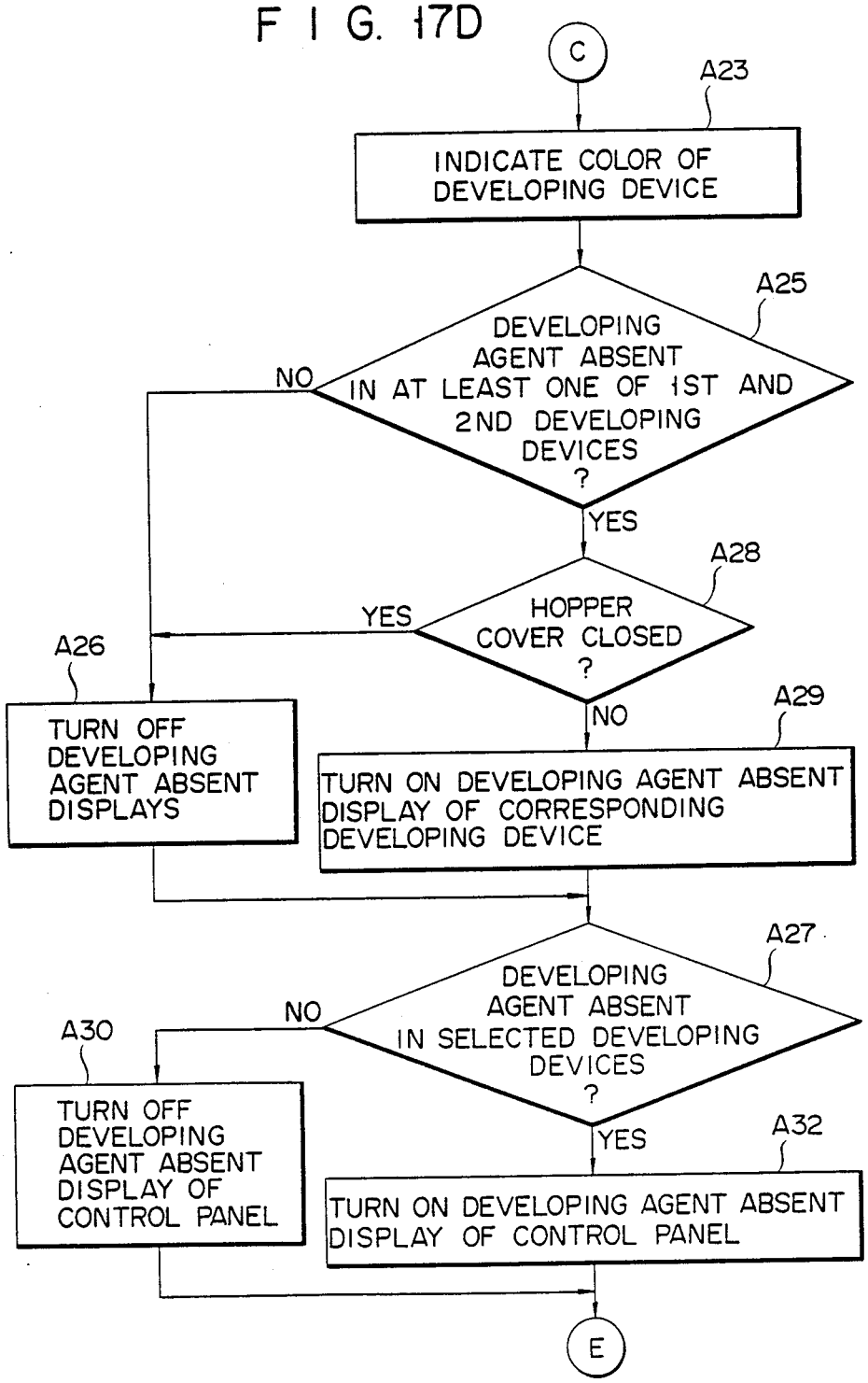
Figure 17E:
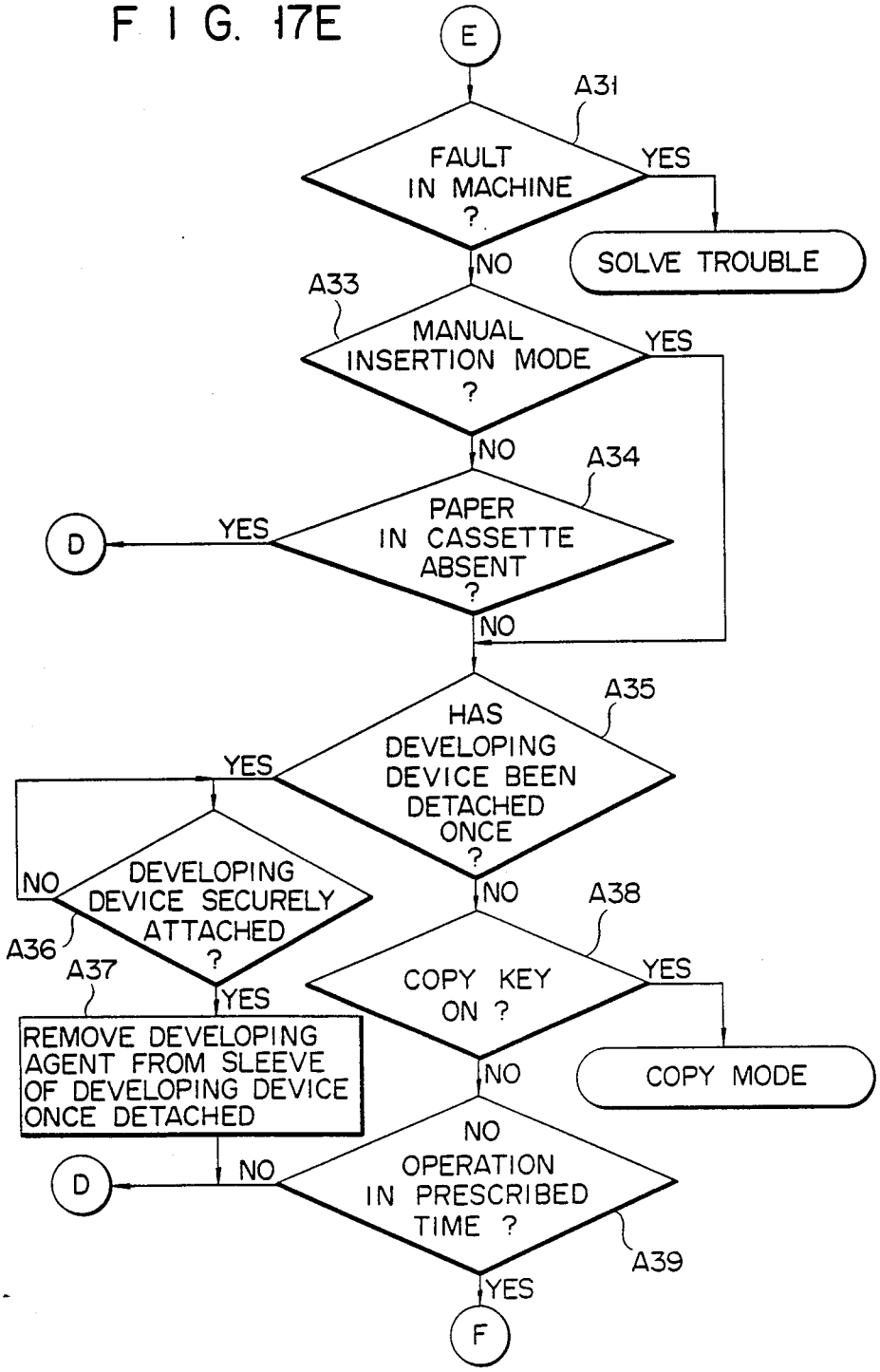
Figure 17F:
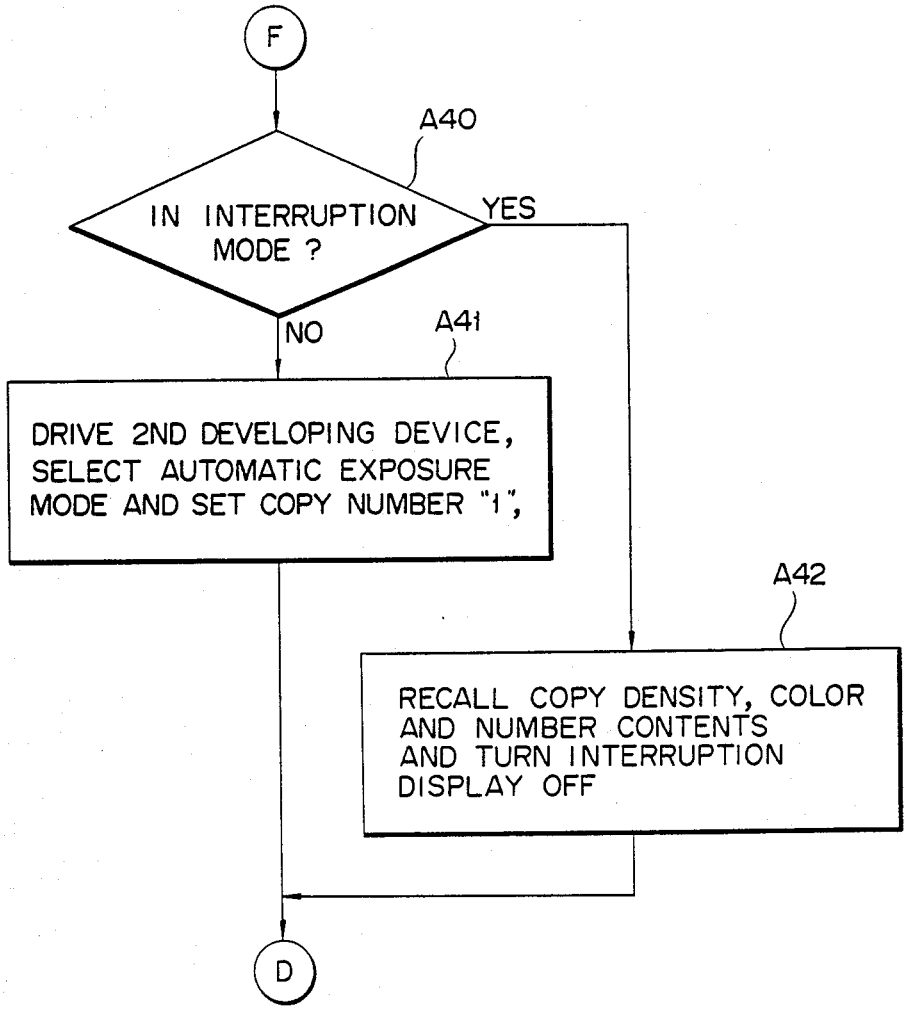
Figure 18A:
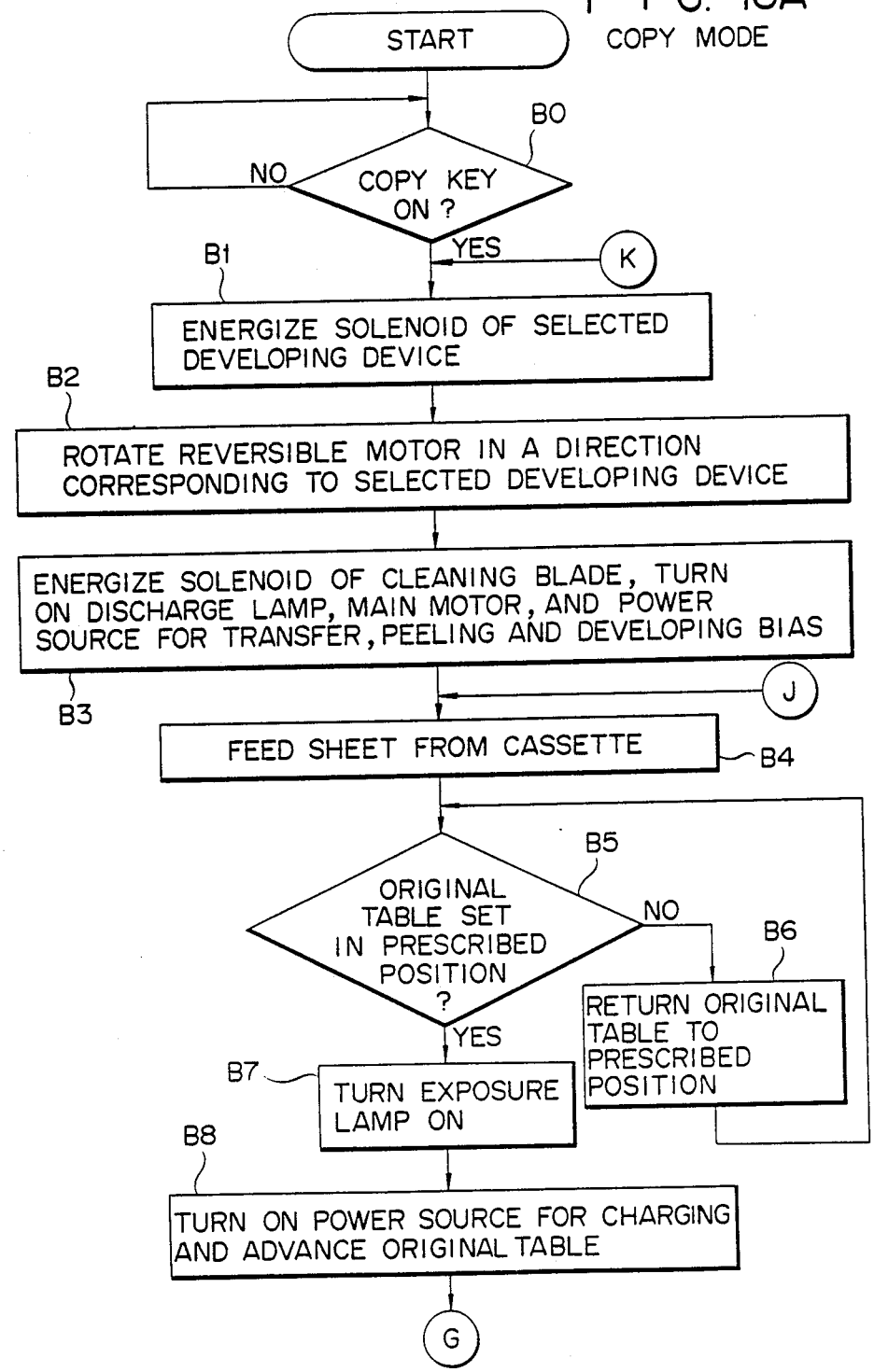
FIGS. 18A to 18D are flow charts for illustrating a copy mode.
Figure 18B:
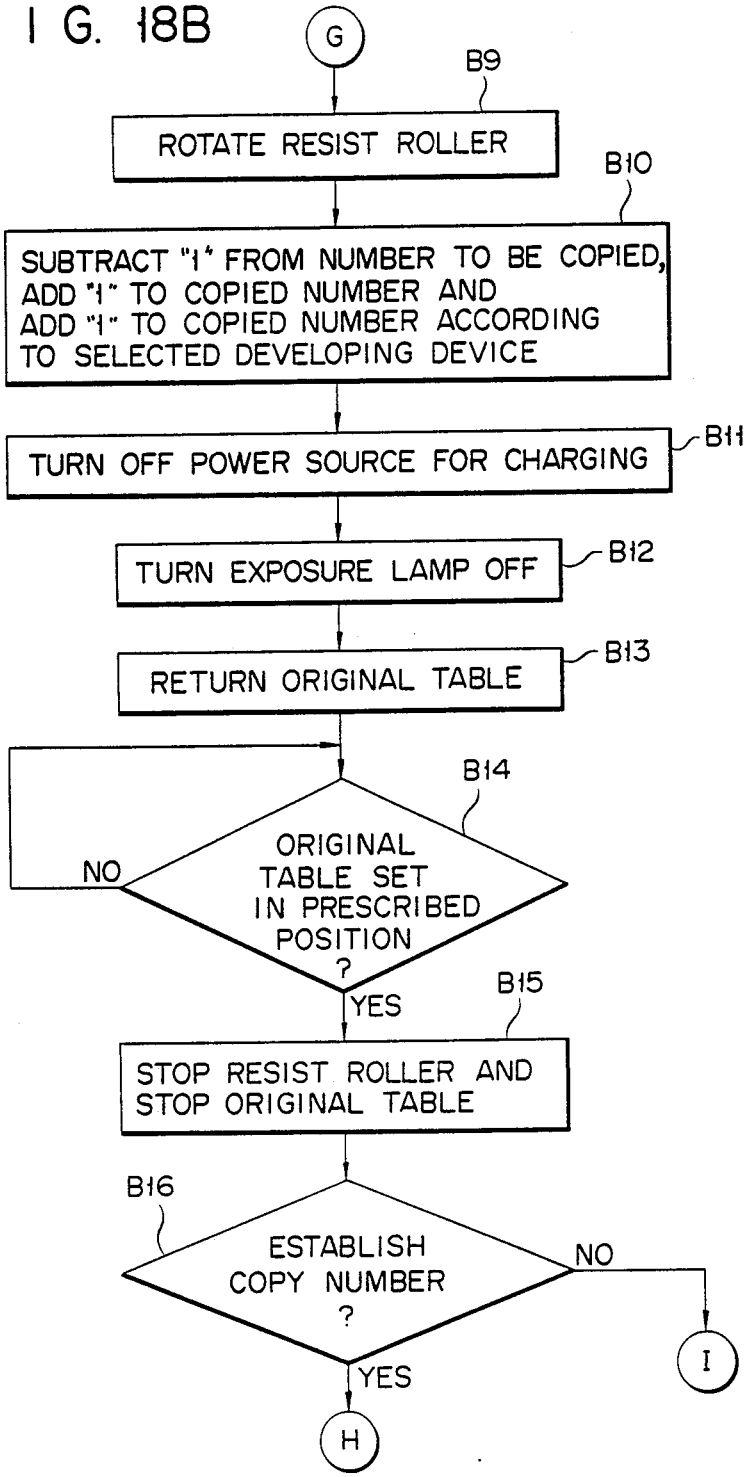
Figure 18C:
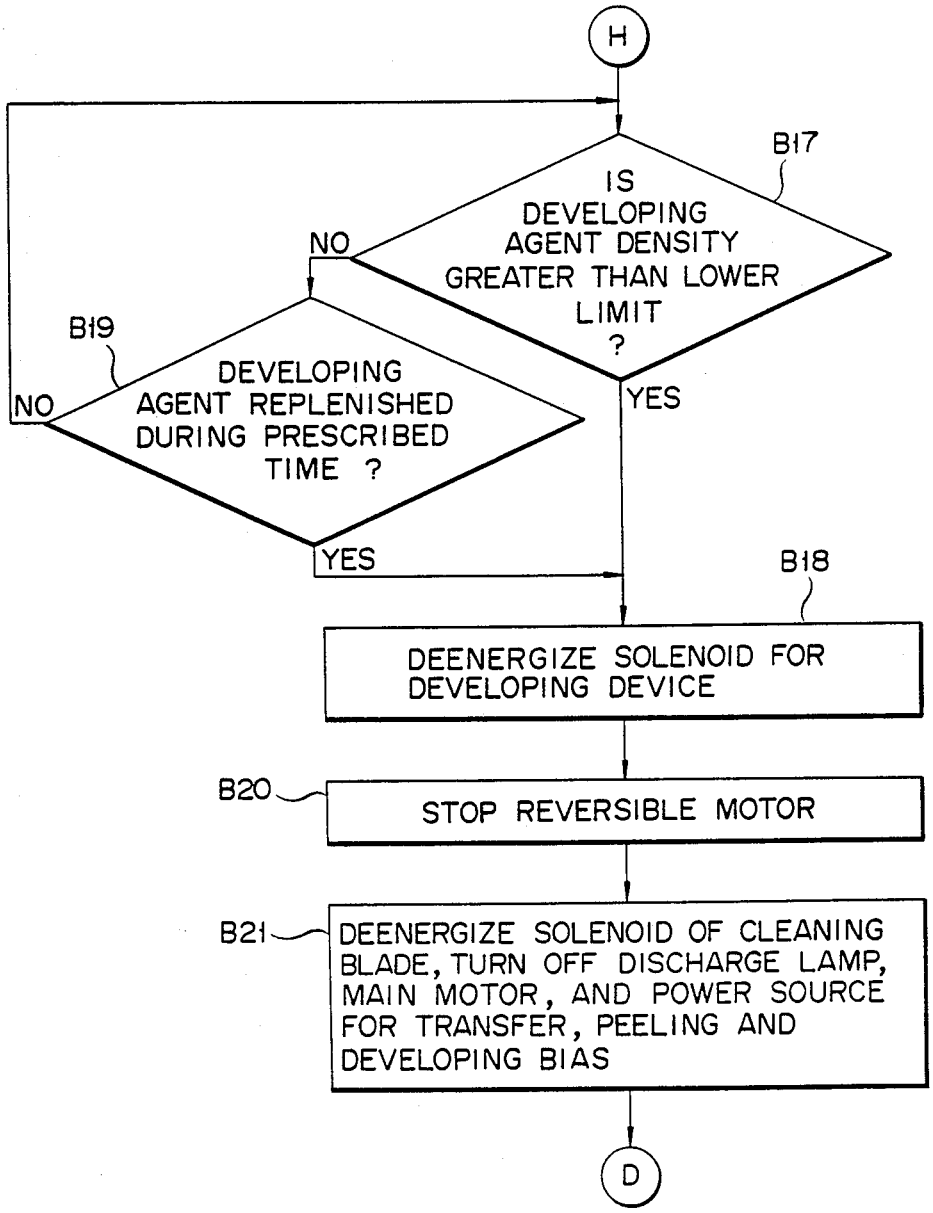
Figure 18D:
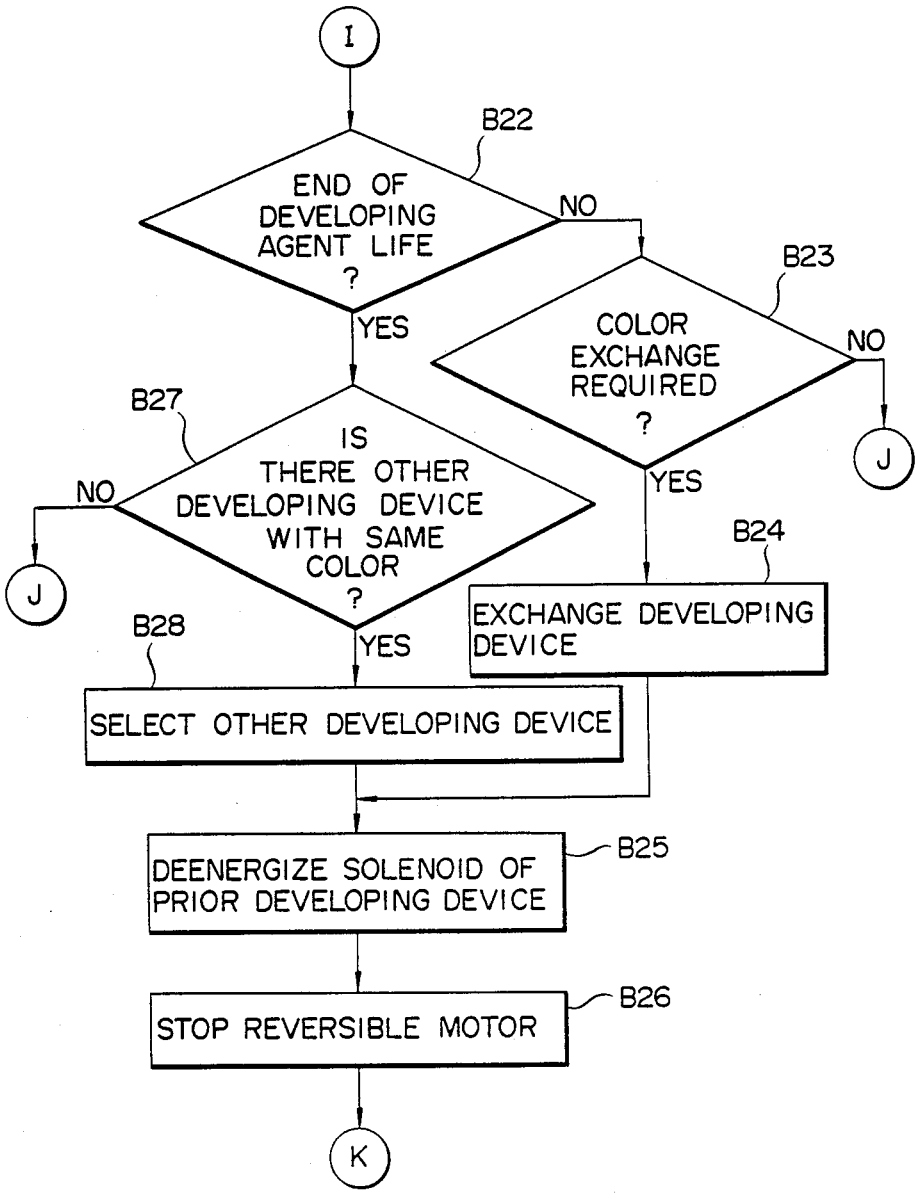

The first and second developing units 32*a* and 32*b* are provided, respectively, with developing unit presence signal generating mechanisms 187*a* and 187*b* for indicating the presence of the developing units, and discriminating information-generating mechanisms 188*a* and 188*b* for producing discriminating codes (indicative of the colors of the developing agents) peculiar to the individual developing units. Signals and discriminating codes from these generating mechanisms 187*a*, 187*b*, 188*a* and 188*b* are applied to the input of the microcomputer 171, through the input interface circuit 172. The developing unit presence signal-generating mechanisms 187*a* and 187*b* and the discriminating information-generating mechanisms 188*a* and 188*b* deliver their respective signals and discriminating codes by utilizing developing unit connectors 191*a* and 191*b*, as Shown in FIG. 16, for electrically connecting the developing units 32*a* and 32*b*, respectively, to the input interface circuit 172.

Each connector 191*a* (191*b*) includes a jack 192*a* (192*b*) and a plug 193*a* (193*b*). The jack 192*a* (192*b*) is provided on the developing unit side, while the plug 193*a* (193*b*) is connected to the input interface circuit 172 of FIG. 15, by means of a cable. A developing unit presence signal is produced by connecting a common terminal $194_1$ with a terminal $194_5$, in the jack 192*a* (192*b*). On the other hand, a 3-bit discriminating code is produced by connecting the common terminal $194_1$ with any of terminals $194_2$, $194_3$, and $194_4$, depending on the developing unit concerned.

In the plug 193*a* (193*b*), a terminal $195_1$ is grounded inside the input interface circuit 172. Thus, when the jack 192*a* (192*b*) and the plug 193*a* (193*b*) are connected, their respective terminals are connected correspondingly. By this connection, a three-bit discriminating code, indicative of the terminal connection of the jack 192, is obtained from terminals $195_2$, $195_3$, and $195_4$ of the plug 193, and a "developing unit present" signal is obtained from a terminal $195_5$. When the jack 192 and the plug 193 are not connected, therefore, the "developing unit present" signal cannot be delivered from the terminal $195_5$ of the plug 193, so that the developing unit(s) can be judged absent.

For example, the memory unit 175 is formed of a CMOS RAM (random access memory) which serves as a counter for counting copies made (or cycles of copying operation). In this embodiment, the memory unit 175 is provided with a plurality of copy counters (not shown) for counting copies for their corresponding developing units 32*a* and 32*b*, and a single total counter for ascertaining the total number of copies. These counters are selected by address designation responsive to the discriminating codes for the developing units, and can store their respective count data. The count data of each copy counter is formed of, for example four bits by five, and is stored in the form of a BCD code. The count data of the total counter is formed of, e.g., four bits by six, and is stored in the form of a BCD code.

The operation of the microcomputer 171 of the copying machine constructed in this manner will now be described in detail.

Referring first to the flow charts of FIGS. 17A to 17F, the operation of the microcomputer 171, following connection to power supply, will be described. When it is detected in step A0 that the power is on, step A1 is entered. In step A1, the second developing unit 32*b*, storing the standard-color or black developing agent is actuated, and the automatic exposure mode is selected. Then comes step A2, in which a heater lamp of the heat roller 19 is turned on. The operation then proceeds to step A3, in which the pole position shifting solenoid 109*b* of the second developing unit 32*b* is deenergized, and the reversible motor 63 is rotated reversely. Subsequently, in step A4, the reversible motor 63 is stopped. Then step A5 is entered in which the pole position shifting solenoid 109*a* of the first developing unit 32*a* is deenergized, and the reversible motor 63 is rotated forwardly. The operation then proceeds to step A6, in which the reversible motor 63 is stopped, whereupon step A7 is entered. Up to step A6, although the second developing unit 32*b*, for black developing, is in a drivable state after the start of power supply, the magnetic brushes 35*a* and 35*b* are prevented from being formed on the surfaces of the first and second developing rollers 31*a* and 31*b*. Thus, if an operator selects either developing mode, the copying machine will get ready for the start of developing operations at once.

In step A7, the main motor 28 is rotated for a prescribed time, and step A8 is then entered. In step A8, the heat roller 19 is checked to see if its warm-up is completed. If completion of the warm-up is detected, the "ready-to-copy" sign 163 on the control panel is lighted, and the copying machine enters a stand-by mode. Then, in step A9, the copying machine is enabled to accept key operation on the control panel.

Thus, the microcomputer 171 automatically executes a series of stand-by control processes after the start of power supply, providing for subsequent copying preparatory control, based on an operator's operation. When the operator performs key operation in step A9, step A10 is entered, in which the interruption key 152 is checked for activation. If the interruption 152 is off, step A11 is entered. If the key 152 is on, step A12 is entered. In step A12, the copying machine is checked to see if it currently is in the interruption mode. If the machine is not in the interruption mode, the operation proceeds to step A13. In step A13, the copying conditions immediately before the activation of the interruption key 152, including the copy density, copy color, and the set number of copies to be made, are saved, the second developing unit 32*b* storing the black developing agent, and the automatic exposure mode are selected, the copy number is set to "1", and the interruption mode is established. Then step A14 is entered. When the interruption mode is established in this manner, the preceding copying conditions are saved, and the machine is switched over to the standard-color or black copy mode. Then, the interruption indicator 153 on the control panel is turned on in step A14, and step A11 is entered.

If the copying machine is found to be in the interruption mode in step A12, the operation proceeds to step A15. In step A15, the copying conditions saved in step A13 are recalled, and the developing unit, and the exposure mode used immediately before the start of the interruption mode are reselected, to cancel the interruption mode. Then step A16 is entered, in which the interruption indicator 153 on the control panel is turned off. The operation then proceeds to step A11.

In step A11, the second developing unit 32*b* is checked for presence, in accordance with a developing unit presence signal responsive to the second developing unit 32*b*. If the second developing unit 32*b* is absent, step A17 is entered. In step A17, the first developing unit 32*a* is checked for presence in accordance with a developing unit presence signal responsive to the first developing unit 32*a*. If the first developing unit 32*a* is absent, step A18 is entered. In step A18, the color indicators 157 to 160 and the "ready-to-copy" sign 163 on the control panel are turned off to restore the stand-by mode. Thus, neither of the first and second developing units 32*a* and 32*b* is set in the machine, and the color indicators 157 to 160 are prohibited from color indication.

If the second developing unit 32*b* is found to be present in step A11, the operation proceeds to step A19. In step A19, the first developing unit 32*a* is checked for presence. If the first developing unit 32*a* is present, step A20 is entered, in which the color selection key 156 is checked for activation. If the color selection key 156 is on, step A21 is entered, in which the machine is checked to see if the second developing unit 32*b* is selected. If the second developing unit 32*b* is not selected, step A22 is entered. In step A22, the second developing unit 32*b* is selected, and the operation then proceeds to step 23. If the first developing unit 32*a* is found to be absent in step A19, steps A20 and A21 are skipped, and step A22 is entered. If the color selection key 156 is found to be off in step A20, steps A21 and A22 are skipped, and step A23 is entered.

If the first developing unit 32*a* is found to be present in step A17, or if the second developing unit 32*b* is found to be selected in step A21, the operation proceeds to step A24. In step A24, the first developing unit 32*a* is selected, and step A23 is then entered. Thus, if neither of the first and second developing units 32*a* and 32*b* is present, or if one of them is absent, selection of the absent developing unit or units is prohibited.

In step A23, the color of the selected developing unit 32*a* or 32*b* is indicated. Namely, the color of the developing agent stored in the selected developing unit 32*a* or 32*b* is identified by the discriminating code delivered from the developing unit, and the color indicator on the control panel corresponding to the identified color is lighted. If the identified color is black, for example, the black indicator 157 is lighted; if red, then the red indicator 158.

After the color indication, the operation proceeds to step A25. In step A25, the first and second developing units 32*a* and 32*b* are checked for the presence of developing agent, in accordance with signals from the developing agent shortage detecting units 117*a* and 117*b*. If both the first and second developing units 32*a* and 32*b* are found to contain their corresponding developing agents, step A26 is entered. In step A26, the respective developing agent absence indicators 140*a* and 140*b* of the first and second developing units 32*a* and 32*b* are turned off. The operation then proceeds to step A27.

If either or both of the developing units 32*a* and 32*b* are found to be short of developing agent in step A25, step A28 is entered. In step A28, the developing device 10 is checked, in accordance with a signal from the cover position detecting unit 135, to see if the hopper cover 131 is in place. If the hopper cover 131 is in place, step A26 is entered; if not, then step A29. In step A29, the developing agent absence indicators 140*a* and/or 140*b* (of the developing unit or units short of developing agent supply) are turned on, and step A27 is then entered. Thus, if the first and second developing units 32*a* and 32*b* are short of their corresponding developing agents G1 and G2, the developing agent absence indicators 140*a* and 140*b*, beside the top openings 132*a* and 132*b* are lighted. The developing agent absence indicators 140*a* and 140*b* cannot, however, be lighted when the hopper cover 131 is in place, that is, they can be turned on only when the hopper cover 131 is lifted.

In step A27, the selected developing unit is checked for the presence of developing agent. If the developing agent is present, step A30 is entered, in which the developing agent absence sign 165 on the control panel is turned off. The operation then proceeds to step A31. If the selected developing unit is found to be short of the developing agent, in step A27, step A32 is entered, in which the developing agent absence sign 165 on the control panel is lighted. The operation then proceeds to step A31. Thus, the developing agent absence sign 165 is turned on only when the selected developing unit is short of its corresponding developing agent.

In step A31, the copying machine is checked for trouble. If the machine is found to be malfunctioning, it is troubleshooted; if not, step A33 is entered.

In step A33, the copying machine is checked to see if it is in a manual paper supply mode using the sheet-bypass guide 6. If the machine is found not to be in the manual supply mode, that is, if it is found to be in an automatic paper supply mode using the paper cassette 3, then step A34 is entered. In step A34, the paper cassette 3 is checked for the presence of sheets P1. If the sheets P1 are absent, the stand-by mode is restored; if present, step A35 is entered. If the machine is found to be in the manual paper supply mode in step A33, step A34 is skipped, and step A35 is entered.

In step A35, the developing device 10 is checked, in accordance with developing unit presence signals from the first and second developing units 32*a* and 32*b*, to see if either of the developing units 32*a* and 32*b* has been detached once. If either of the developing units is found to have been detached once, step A36 is entered. In step A36, the developing unit concerned is checked for secureness in attachment, in accordance with a signal from the cover position detecting unit 135. If the cover position detecting unit 135 detects that the hopper cover 131 is in place, the developing unit is judged to be securely attached.

When the secure attachment of the developing unit is ascertained, step A37 is entered. In step A37, the developing agent is removed from the surface of the sleeve of the developing unit detached by the processes in steps A3 to A6, and the stand-by mode is restored. Thus, if the developing unit is detached with the power on, the developing agent on the sleeve of the detached developing unit is removed after the developing unit is securely attached.

If neither of the developing units 32*a* and 32*b* is found to have been detached in step A35, step A38 is entered. In step A38, the copy key 151 on the control panel is checked for activation. If the copy key 151 is on, a copy mode as described later in detail is entered; if not, step A39. In step A39, the copying machine is checked to see if no key operation on the control panel has been performed for a prescribed time. If any key operation is found to have been performed during the prescribed time, the stand-by mode is restored; if not, step A40 is entered. In step A40, the machine is checked to see if it is currently in teh interruption mode. If the machine is not found to be in the interruption mode, step A41 is entered. In step A41, the second developing unit 32*b* storing the black developing agent, and the automatic exposure mode are selected, the copy number is set to "1", and the stand-by mode is restored. Thus, if the copying machine is not operated for a prescribed time after a cycle of normal copying operation is ended, it is switched over to the standard-color or black-copy mode, and the automatic exposure mode.

If the copying machine is found to be in the interruption mode in step A40, step A42 is entered. In step A42, the copying conditions saved at the time of establishing the interruption mode are recalled, the interruption indicator 153 on the control panel is turned off, and the stand-by mode is restored. Thus, if the copying machine is not operated for the prescribed time after a copying operation is performed in the interruption mode, the mode enjoyed immediately before the start of the interruption mode is restored.

Referring now to the flow charts in FIGS. 18A to 18D, a copy mode will be described in detail. When it is detected in step B0 that the copy key 151 on the control panel is on, step B1 is entered. In step B1, the pole position shifting solenoid 109*a* or 109*b* of the selected developing unit is energized. Then comes step B2, in which the reversible motor 63 is rotated in a direction corresponding to the selected developing unit. The operation then proceeds to step B3, in which the blade solenoid 29 of the cleaning unit 13, discharge lamp 14, main motor 28, transfer power source 181 (transfer charger 11), separation power source 182 (separation charger 12), and developing bias power source 179 are energized or turned on. Then step B4 is entered, in which automatic paper feed from the paper cassette 3 is started. Subsequently, in step B5, the original table 2 is checked for position. If the original table 2 is not in the prescribed position, it is returned thereto in step B6. When the table 2 is thus restored, step B7 is entered.

In step B7, the exposure lamp 22 is turned on. Then step B8 is entered, in which the charging power source 180 (main charger 8) is turned on to start charging the photoconductive drum 7, and the original table 2 is advanced to start original scanning. The operation then proceeds to step B9, in which the aligning rollers 18 are rotated to feed the sheet P1 to the image transfer section 16. Then step B10 is entered.

In step B10, "1" is subtracted from the number currently indicated by the copy number display 155 on the control panel, and "1" is added to the current number in each of the total counter in the memory unit 175, and the copy counter, in the same memory unit 175, for the selected developing unit. The operation then proceeds to step B11, in which the charging power source 180 is turned off, to stop charging the photoconductive drum 7. Then step B12 is entered, in which the exposure lamp 22 is turned off. Subsequently, in step B13, the original table 2 is returned. Then step B14 is entered.

In step B14, the original table 2 is checked for position. If the original table 2 is found to have returned to the prescribed position, step B15 is entered. In step B15, the aligning rollers 18 are stopped from rotating, and the original table 2 is stopped from moving rearward. The operation then proceeds to step B16, in which the copying machine is checked to see if the prescribed number of copies is reached. If the prescribed number is reached, step B17 is entered.

In step B17, the selected developing unit **32*a* or 32*b* is checked, in accordance with a signal from its developing agent density detector 42*a* or 42*b*, to see if the developing agent density of the selected developing unit 32*a* or 32*b* is higher than the lower limit. If the developing agent density is higher than the lower limit, step B18 is entered; if not, then step B19. In step B19, the machine is checked to see if the developing agent has continuously been supplied for a prescribed time. If the continuous replenishment is not detected, step B17 is resumed for the repetition of the aforementioned operation. If the continuous developing agent supply for the prescribed time is detected, step B18** is entered; Namely, in the automatic developing agent density control, there are provided a proper density level and the lowest density level that would not result in a change of the fluidity of the developing agent, and at the end of the copying operation, the developing unit drive and developing agent supply are continued until the density of the developing agent reaches the lowest level.

In step B18, the pole position-shifting solenoid **109*a* or 109*b*, of the selected developing unit 32*a* or 32*b*, is deenergized. Then step B20 is entered, in which the reversible motor 63 is stopped. The operation then proceeds to step B21, in which the blade solenoid 29, main motor 28, discharge lamp 14, transfer power source 181, separation power source 182, and developing bias power source 179** are deenergized or turned off, and the stand-by mode is restored.

If the set number of copies is found not to have been reached in step B16, step B22 is entered. In step B22, the developing agent is checked for life, by checking the copy counter, in the memory unit 175, for the selected developing unit, to see if the current number in the copy counter has not reached the prescribed number. If the life of the developing agent is not ended, step B23 is entered.

In step B23, a color change request flag (mentioned later) is checked to see if there is a request for a change of color. If there is no such request (flag=0), step B4 is resumed for the repetition of the aforementioned operation. If there is a request for the a color change (flag=1), step B24 is entered. In step B24, the selected developing unit is changed. Then step B25 is entered, in which the pole position-shifting solenoid of the previously selected developing unit is deenergized. The operation then proceeds to step B26, in which the reversible motor 63 is stopped. Then step B1 is resumed for the repetition of the aforementioned operation. Thus, if the developing is required to be changed during the copying operation, it is replaced with the other, after a correct cycle of developing operation is ended, at the earliest.

If the life of the developing agent is found to be ended in step B22, step B27 is entered. In step B27, the copying machine is checked for the presence of any other developing unit of the same color. If there is no such developing unit, step B4 is resumed for the repetition of the aforementioned operation. If there is any other developing unit of the same color, step B28 is entered. In step B28, the developing unit of the same color is selected. The operation then proceeds to step B25. Thus, if the life of the developing agent in the developing unit being used is ended, the developing unit is replaced preferentially with another developing unit storing developing agent of the same color, if any.

Figure 19A:
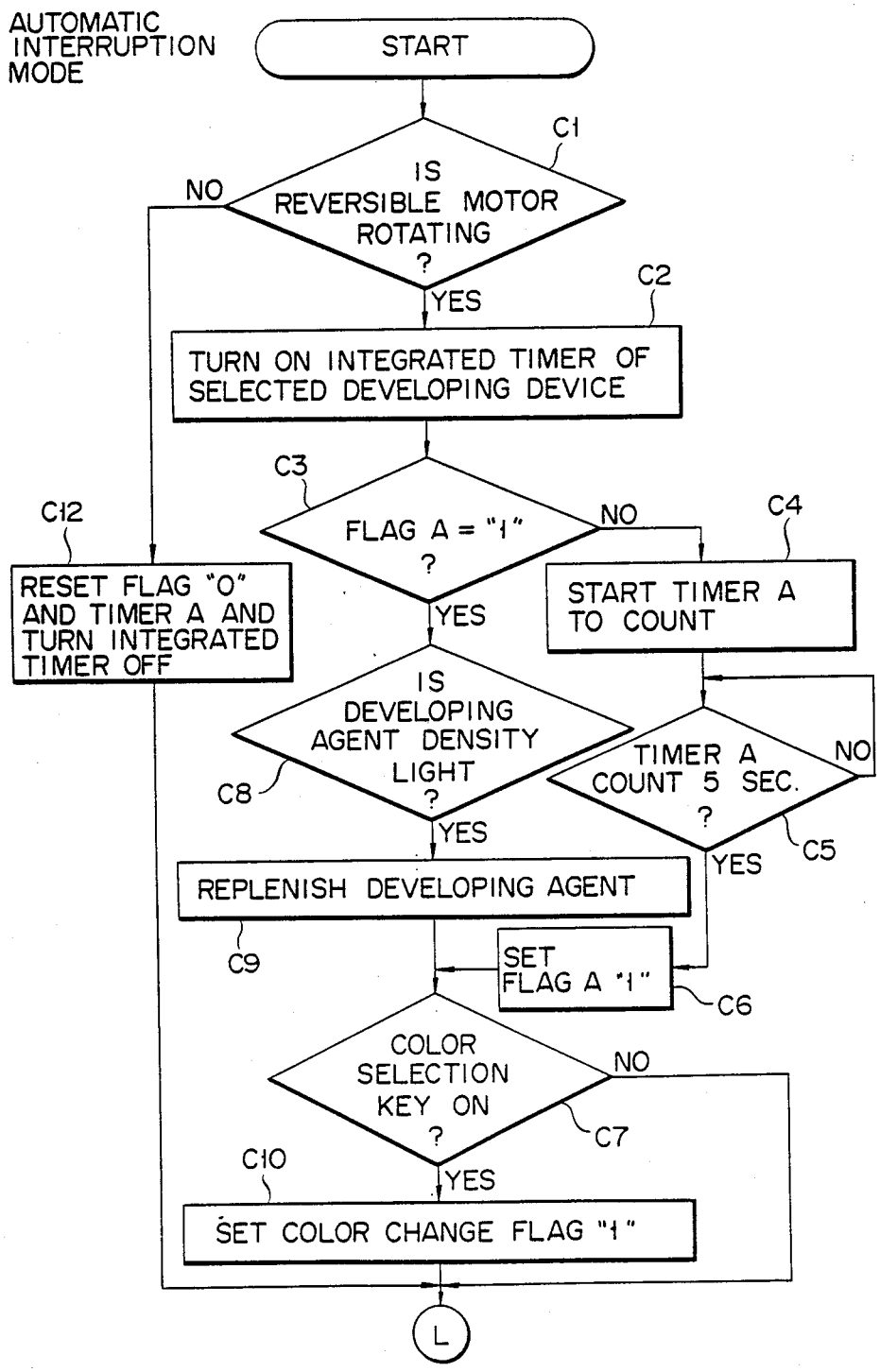
FIGS. 19A and 19B are flow charts for illustrating an automatic interruption mode.
Figure 19B:
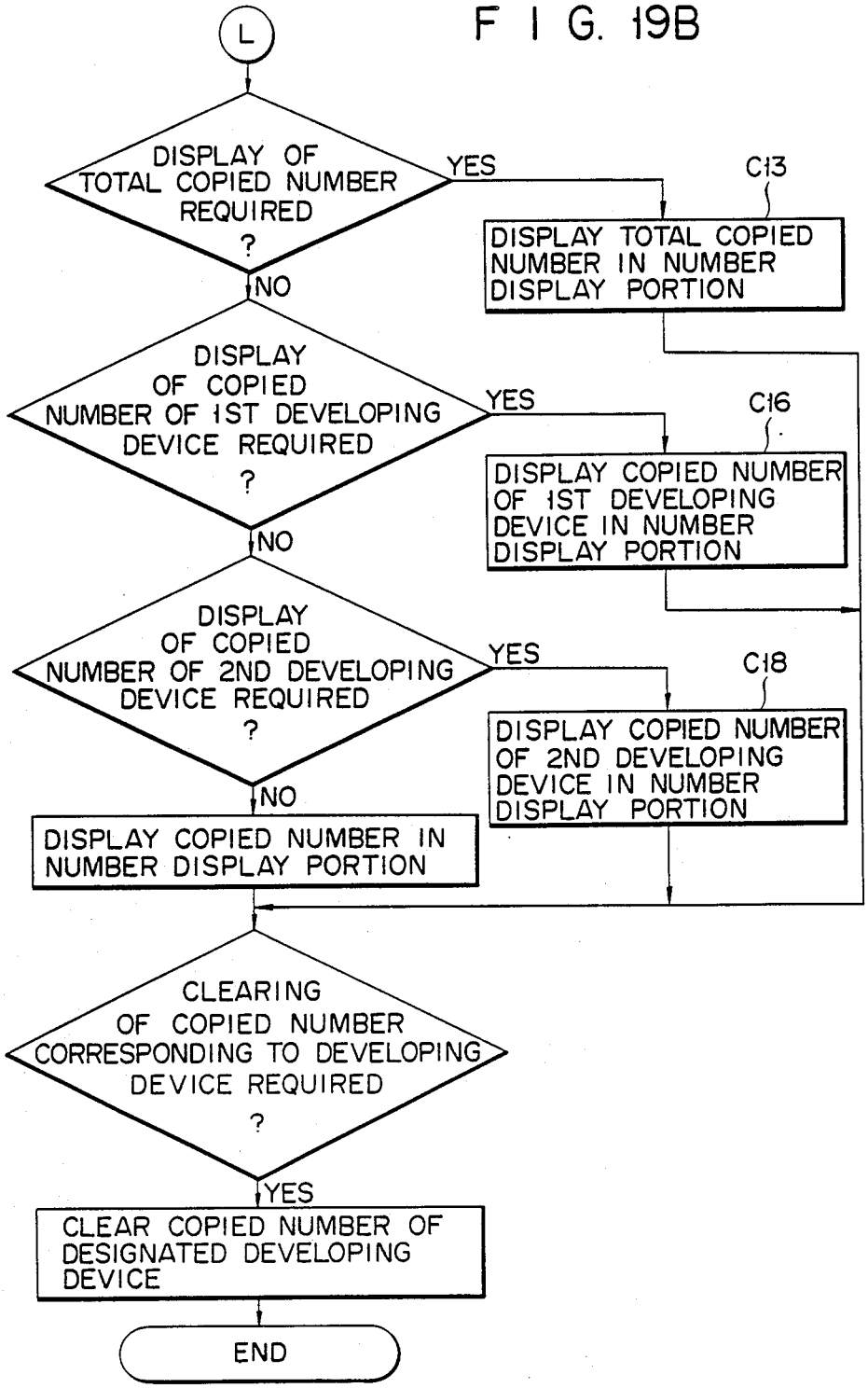

Referring now to the flow charts of FIGS. 19A and 19B, the automatic interruption mode will be described in detail. The copying machine is set so that the automatic interruption is repeated at regular time intervals.

When the automatic interruption is started, step C1 is entered, in which the reversible motor 63 is checked for rotation. If the reversible motor 63 is found to be rotating, step C2 is entered, in which the integrating timer **139*a* or 139*b*, of the operating developing unit, is energized. The operation then proceeds to step C3, in which a flag A is checked for value. If the flag A is not "1", step C4 is entered, in which a timer A starts counting. Then, in step C5, the timer A is checked to see if is has counted for 5 seconds. If 5-second counting is detected, step C6 is entered, in which "1" is set in the flag A. The operation then proceeds to step C7. If the 5-second count is not detected in step C5, step C5 is maintained for 5** seconds.

If the flag A is found to be "1" in step C3, step C8 is entered. In step C8, the selected developing unit is checked for developing agent density, in accordance with a signal from the developing agent density detector **42*a* or 42*b* of the selected developing unit. If the developing agent density is lower than a prescribed level, step C9 is entered. In step C9, the developing agent supply roller 52*a* or 52*b*, of the selected developing unit, is driven for developing agent supply. The operation then proceeds to step C7. If the developing agent density is found to be higher than the prescribed level in step C8, step C9 is skipped, and step C7 is entered directly from step C8**.

Thus, in the density check, the flag A is "0" immediately after the start of power supply, so that it is judged to be not "1" in step C3, and step C4 is entered. In steps C4 to C6 following step C3, "1" is set in the flag A within 5 seconds after the start of counting of the timer A. Thus, in the copying operation, the density check is achieved on the basis of the output of the developing agent density detector 42a or 42b, after the passage of a predetermined time (e.g., about 5 seconds) required for the flow of the developing agent to the detector 42a or 42b to stabilize, after the start of developing agent supply to the magnet roll 43a or 43b. In other words, the density check is performed after the developing agent flow is stabilized, and is therefore improved in reliability.

In step C7, the color selection key 156 on the control panel is checked for activation. If the color selection key 156 is on, step C10 is entered, in which "1" is set in the color change request flag. The operation then proceeds to step C11. If the color selection key 156 is found out to be on in step C7, step C10 is skipped, and step C11 is entered directly after step C7.

If the reversible motor 63 is found not to be rotating in step C1, step C12 is entered. In step C12, "0" is set in the flag A, the timer A is reset, and the integrating timer 139a or 139b is deenergized. Then step C11 is entered.

In step C11, the copying machine is checked to see if there is any request for the indication of the total number of copies (input in cipher through the ten-key array 154 on the control panel). If there is a request for the indication, step C13 is entered. In step C13, the current number in the total counter in the memory unit 175 is indicated by the copy number display 155 on the control panel. The operation then proceeds to step C14.

If no request for the indication of the total copy number is detected in step C11, step C15 is entered. In step C15, the copying machine is checked to see if there is any request for the indication of the number of copies made, by the use of the first developing unit 32a (input in cipher through the ten-key array 154). If there is a request for the indication, step C16 is entered. In step C16, the current number in the copy counter in the memory unit 175, corresponding to the first developing unit 32a, is indicated by the copy number display 155. The operation then proceeds to step C14.

If no request for the indication is detected in step C15, step C17 is entered. In step C17, the copying machine is checked to see if there is any request for the indication of the number of copies made by the use of the second developing unit 32b (input in cipher through the ten-key array 154). If there is a request for the indication, step C18 is entered. In step C18, the current number in the copy counter in the memory unit 175, corresponding to the second developing unit 32b, is indicated by the copy member display 155. The operation then proceeds to step C14.

If no request for the indication is detected in step C17, step 19 is entered. In step C19, the normal number of copies is indicated by the copy number display 155. The operation then proceeds to step C14, in which the copying machine is checked to see if there is any request for clearing of the number of copies for either of the developing units (input in cipher for the developing unit concerned through the ten-key array 154). If no request for clearing is detected, the automatic interruption mode is ended. If there is a request for clearing, step C20 is entered. In step C20, the current number in the copy counter in the memory unit 175, corresponding to the designated developing unit, is cleared, and the automatic interruption mode is ended.

In the present embodiment, as described in detail herein, the developing device is provided with two developing units, and a switch for alternatively driving the two developing units is provided on a control panel. Thus, there may be provided an image-forming apparatus which can form an image in an image-forming mode selected among a plurality of image-forming modes, without replacing cartridges including developing units.

In this image-forming apparatus, a copy mode for black, which is commonly used as a standard color, is automatically established when the power is turned on or if no operation is performed for a prescribed time after a copying operation, in a mode for any other color than black, is ended. Thus, the apparatus to this embodiment is very serviceable and easy to operate, requiring no key operation for restoring the black or standard-color copy mode.

If one or either of the first and second developing units is not set in the copying machine housing, it is prevented from being selected. Accordingly, there will not be caused such an operation error, where a copying operation will be started without a developing unit in the copying machine, and the operating efficiency will thus be improved.

If an interruption mode is established in the middle of a copying operation in a mode for a certain color other than black, the black or standard-color copy mode is automatically selected. Thus, a user, as an interrupter, need not perform any key operation for restoring the black copy mode. Moreover the selection of the developing unit (or color selection) can be achieved even during the interruption mode, and that mode which has been enjoyed before the start of the interruption mode can automatically be restored when the interruption mode is canceled. Thus, the apparatus or copying machine is further improved in its convenience.

The copying maching is checked to see if either of the developing units has been detached with the power on. If a detachment is detected, the developing unit concerned is checked for secureness in attachment. If it is ascertained that the developing unit is securely attached, it is operated so as to remove any developing agent on its developing roller (sleeve). Accordingly, the developing agent cannot remain on the developing roller of the previously detached developing unit, after the developing unit is set in place, so that color mixing will never be caused in developing, through use of the other developing unit.

Furthermore, a developing agent storage portion of black developing means is made larger in capacity than that of color developing means. Thus, the selection between black and color developing processes can be achieved very easily, and the black developing process, which should be executed more frequently, can be accomplished without requiring very frequent developing agent supply.

Although the standard color has been described as being black in the above embodiment, it may be any other color than black.

In the embodiment described above, moreover, the present invention is applied to a two-color copying machine. It is to be understood, however, that the invention is not limited to this embodiment, and may be applied to any image-forming apparatuses that can form images by means of developing units, such as facsimiles or so-called multicolor copying machines using three or more copy colors.

What is claimed is:

1. An image-forming apparatus comprising:

an image carrier;

latent image-forming means for forming an electrostatic latent image on a surface of said image carrier;

first developing means for developing the electrostatic latent image formed on said image carrier, by means of a first color developing agent, said first developing means including first magnetic pole means, and drive means for causing said first magnetic pole means to assume a developing position in which the first developing agent is attracted magnetically and supplied to said image carrier, or a non-developing position in which the supply of the first developing agent to said image carrier is stopped;

second developing means for developing the electrostatic latent image formed on said image carrier, by means of a second color developing agent different in color from said first developing agent, said second developing means including second magnetic pole means, and drive means for causing said second magnetic pole means to assume a developing position in which the second developing agent is attracted magnetically and supplied to said image carrier, or a non-developing position in which the supply of the second developing agent to said image carrier is stopped; and selecting means for causing one of the first and second magnetic pole means to assume said developing position, and for causing the other of the first and second magnetic pole means to assume the non-developing position, to thereby perform a developing operation by a selected one of said first and second developing means, wherein said first and second developing means each include a developing roller which has a magnet roll and a sleeve surrounding said magnet roll, and a doctor arranged at a predetermined distance from a predetermined portion of an outer peripheral surface of said sleeve, and said first and second magnetic pole means each include a conveying magnetic pole for permitting and prohibiting the conveying of the corresponding developing agent to the image carrier in the developing and non-developing positions, respectively, and a developing magnetic pole which is moved to a position closest to the image carrier in the developing position for supplying the corresponding developing agent to the image carrier, and which is moved away from the image carrier in the non-developing position.

2. The image-forming apparatus according to claim 1, wherein said first and second developing means comprise first and second hoppers for containing said first and second developing agents, respectively.

3. The image-forming apparatus according to claim 2, wherein said magnetic poles form a magnetic brush on the surfaces of said sleeves, by means of said first and second developing agents supplied from said first and second hoppers, respectively, when said first and second hoppers are in the respective developing positions.

4. The image-forming apparatus according to claim 3, wherein said first and second developing agents are fed to the image carrier by the rotation of the respective sleeves.

5. The image-forming apparatus according to claim 4, wherein said doctors regulate the thickness of said magnetic brush formed on the surface of the respective sleeves.

6. The image-forming apparatus according to claim 5, wherein said first and second developing agents are respectively supplied from said first and second hoppers to the sleeves via said doctors.

7. The image-forming apparatus according to claim 2, wherein said second developing agent is black, and said first developing agent is any color other than black.

8. The image-forming apparatus according to claim 7, further comprising a control panel, and wherein said selecting means comprises a selector switch provided on said control panel for selecting said first or second developing means, to drive the same.

9. The image-forming apparatus according to claim 7, wherein said selecting means selects said second developing means when the power is turned on.

10. The image-forming apparatus according to claim 7, wherein said selecting means first selects said first developing means, and then said second developing means upon the lapse of a predetermined period of time.

11. The image-forming apparatus according to claim 1, wherein said developing and conveying magnetic poles are provided at an inner periphery of said magnet roll.

12. The image-forming apparatus according to claim 11, wherein said selecting means rotates said magnet roll, to thereby rotate the magnetic poles such that the magnetic pole means is set in the developing or non-developing position.

13. The image-forming apparatus according to claim 12, wherein said developing magnetic pole is located closer to said image carrier than said conveying magnetic pole.

14. An image-forming apparatus comprising:

an image carrier;

latent image-forming means for forming an electrostatic latent image on a surface of said image carrier;

first developing means for developing the electrostatic latent image formed on said image carrier, by means of a first developing agent, said first developing means including first magnetic pole means, and drive means for causing said first magnetic pole means ot assume a developing position in which the first developing agent is attracted magnetically and supplied to said image carrier, or a non-developong position in which the supply of the first developing agent to said image carrier is stopped;

second developing means for developing the electrostatic latent image formed on said image carrier, by means of a second developing agent different from said first developing agent, said second developing means including second magnetic pole means, and drive means for causing said second magnetic pole means to assume a developing position in which the second developing agent is attracted magnetically and supplied to said image carrier, or a non-developing position in which the supply of the second developing agent to said image carrier is stopped; and selecting means for causing one of the first and second magnetic pole means to assume said developing position, and for causing the other of the first and second magnetic pole means to assume the non-developing position, to thereby perform a developing operation by a selected one of said first and second developing means;

wherein said first and second magnetic pole means each include a conveying magnetic pole for permitting and prohibiting the conveying of the correponding developing agent to the image carrier in the developing and non-developing positions, respectively, and a developing magnetic pole which is moved to a position closest to the image carrier in the developing position for supplying the corresponding developing agent to the image carrier, and which is moved away from the image carrier in the non-developing position.

15. The image-forming apparatus according to claim 14, wherein said first and second developing means comprise first and second developing rollers, respectively.

16. The image-forming apparatus according to claim 14, wherein said developing and conveying magnetic poles are provided at an inner periphery of said magnet roll.

17. The image-forming apparatus according to claim 16, wherein said selecting means rotates said magnet roll, to thereby rotate the magnetic poles such that the magnetic pole means is set in the developing or non-developing position.

18. The image-forming apparatus according to claim 17, wherein said developing magnetic pole is located closer to said image carrier than said conveying magnetic pole.

19. An image-forming apparatus comprising:

an image carrier;

latent image-forming means for forming an electrostatic latent image on a surface of said image carrier;

first developing means for developing the electrostatic latent image formed on said image carrier, by means of a first developing agent, said first developing means including a first developing roller for guiding said first developing agent, first magnetic pole means, drive means for causing said first magnetic pole means to assume a developing position in which the first developing agent is attracted magnetically and supplied to said image carrier along said first developing roller, or a non-developing position in which the supply of the first developing agent to said image carrier is stopped, and a first supply port through which the first developing agent is supplied to said first developing roller, said first magnetic pole means including a plurality of magnetic poles, one of the magnetic poles being made to face said first supply port when said first magnetic pole means is at the non-developing position and being turned away from said first supply port when said first magnetic pole means is at the developing position;

second developing means for developing the electrostatic latent image formed on said image carrier, by means of a second developing agent different from said first developing agent, said second developing means including a second magnetic roll for guiding said second developing agent, second magnetic pole means, drive means for causing said second magnetic pole means to assume a developing position in which the second developing agent is attracted magnetically and supplied to said image carrier along said second developing roller, or a non-developing position in which the supply of the second developing agent to said image carrier is stopped, and a second supply port through which the second developing agent is supplied to said second magnetic roll, said second magnetic pole means including a plurality of magnetic poles, one of the magnetic poles being made to face said second supply port when said second magnetic pole means is at the non-developing position and being turned away from said second supply port when said second magnetic pole means is at the developing position; and selecting means for causing one of said first and second magnetic pole means to assume the developing position, and for causing the other of the first and second magnetic pole means to assume the non-developing position, to thereby perform a developing operation by a selected one of said first and second developing means.

* * * * *